US007832104B2

(12) United States Patent
Yamasaki et al.

(10) Patent No.: US 7,832,104 B2
(45) Date of Patent: Nov. 16, 2010

(54) HAIR REMOVING APPARATUS

(75) Inventors: Masanobu Yamasaki, Hikone (JP); Toshiyuki Tsushio, Hikone (JP); Takeshi Shiba, Hikone (JP); Juzaemon Iwasaki, Nagahama (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 39 days.

(21) Appl. No.: 11/577,826

(22) PCT Filed: Dec. 16, 2005

(86) PCT No.: PCT/JP2005/023145

§ 371 (c)(1),
(2), (4) Date: Apr. 24, 2007

(87) PCT Pub. No.: WO2006/064909

PCT Pub. Date: Jun. 22, 2006

(65) Prior Publication Data

US 2007/0261249 A1 Nov. 15, 2007

(30) Foreign Application Priority Data

Dec. 16, 2004 (JP) ..... 2004-364828

(51) Int. Cl.
*B26B 19/12* (2006.01)
*B26B 19/00* (2006.01)
*B26B 19/28* (2006.01)
*B26B 19/04* (2006.01)

(52) U.S. Cl. ..... 30/43.7; 30/43.9; 30/34.1; 30/45; 30/42; 30/346.51

(58) Field of Classification Search ..... 30/43.9, 30/43.92, 34.1, 43.7, 43.8, 43.91, 42, 44, 30/45, 346.51; 606/133
See application file for complete search history.

(56) References Cited

U.S. PATENT DOCUMENTS 2,074,544 A * 3/1937 Fernberg ..... 30/44

(Continued)

FOREIGN PATENT DOCUMENTS

JP 64-056089 3/1989

(Continued)

OTHER PUBLICATIONS

English Language Abstract of JP 65-056089.

(Continued)

*Primary Examiner*—Ghassem Alie
*Assistant Examiner*—Bharat C Patel
(74) *Attorney, Agent, or Firm*—Greenblum & Bernstein P.L.C.

(57) ABSTRACT

The invention provides a hair removing apparatus having a body hair treatment head removing a body hair by shaving the body hair, depilating the body hair or cutting the body hair, and a main body grip held by a hand, and in which the body hair treatment head being rotatably coupled to the main body grip in such a manner that the body hair treatment head is freely oscillated with respect to the main body grip. In this structure, the hair removing apparatus is provided with a weight applying means for applying a force opposing to a force by which the body hair treatment head is oscillated by its own weight of the body hair treatment head around a center of rotation of the body hair treatment head.

14 Claims, 24 Drawing Sheets

U.S. PATENT DOCUMENTS

| | | | | |
|---|---|---|---|---|
| 2,286,443 | A * | 6/1942 | Scully | 30/43.92 |
| 2,950,530 | A * | 8/1960 | Fox | 30/41.5 |
| 5,921,134 | A * | 7/1999 | Shiba et al. | 74/110 |
| 6,226,871 | B1 * | 5/2001 | Eichhorn et al. | 30/43.92 |
| 6,892,457 | B2 | 5/2005 | Shiba et al. | |
| 7,020,966 | B2 * | 4/2006 | Shiba et al. | 30/43.92 |
| 7,127,818 | B2 | 10/2006 | Sato et al. | |
| 2005/0229400 | A1 | 10/2005 | Yamaguchi et al. | |

FOREIGN PATENT DOCUMENTS

| | | |
|---|---|---|
| JP | 6-126044 | 5/1994 |
| JP | 6-126045 | 5/1994 |
| JP | 6-335575 | 12/1994 |
| JP | 8-089671 | 4/1996 |
| JP | 2004-216067 | 8/2004 |

OTHER PUBLICATIONS

English Language Abstract of JP 6-335575.
English Language Abstract of JP 2004-216067.
English Language Abstract of JP 8-089671.
English Language Abstract of JP 6-126044.
English Language Abstract of JP 6-126045.

* cited by examiner (a)

(b)

HAIR REMOVING APPARATUS

TECHNICAL FIELD

The present invention relates to a hair removing apparatus such as an electric shaver shaving hair, a depilating apparatus plucking out the hair, a hair dressing device cutting the hair and the like, and more particularly to a hair removing apparatus structured such that a body hair treatment head removing the hair oscillates in a back and forth direction or a right and left direction with respect to a main body grip, thereby shaving the hair, depilating the hair or cutting the hair.

BACKGROUND ART

Conventionally, in the electric shaver, for the purpose of improving a quick shaving performance and improving a skin contact and a fit feeling, there have been proposed a lot of techniques structured such that a shaving portion is provided in a shaving head, and the shaving head is moved in such a manner as to be oscillated with respect to a main body grip held by a hand so as to be brought into close contact with a skin (for example, refer to Japanese Patent Application Laid-Open No. 64-56089 and Japanese Patent Application Laid-Open No. 6-335575).

In Japanese Patent Application Laid-Open No. 64-56089, there is described an electric shaver provided with a swing type shaving head, and the structure is made such that a shaving head is oscillated with respect to a main body grip so as to swing by rotatably installing the shaving head provided with a shaving portion to the main body grip. At this time, the shaving head is rotatably installed in such a manner that a portion near a top portion corresponding to an upper portion of the shaving head forms a center of rotation, on the assumption that the shaving head side is set to an upper side and the main body grip side is set to a lower side, and a gravity point of the shaving head is positioned below the center of rotation. In the structure of Japanese Patent Application Laid-Open No. 64-56089, in the case that the shaving head is unloaded, that is, in a state in which no external force is applied, the shaving head hangs in such a manner that the gravity point is positioned below due to its own weight at a time of setting the main body grip horizontally for getting a shape in a cheek or the like, and there is a problem that it is hard to apply the top portion corresponding to the main shaving portion of the shaving head to the cheer. Further, if it is intended to apply the main body grip to the cheek so as to set the shaving head horizontally for applying a blade surface of the top portion of the shaving head, a moment of rotation is applied to the lower portion of the shaving head due to its own weight, the top portion of the shaving head is detached from the cheek, and a pressing force of the top portion of the shaving head is short, thereby generating a problem that a following performance to the skin is deteriorated.

Japanese Patent Application Laid-Open No. 6-335575 is provided with a means for returning to an initial position for improving the problem that it is hard to apply to the cheek due to the hanging caused by its own weight as mentioned above. This is structured such that a rotating shaft is provided near right and left upper ends of the shaving head provided with a plurality of outer blades, the shaving head follows the skin with respect to various shaving ways by making the shaving head rotatable back and forth around the rotating shaft, a helical torsion coil spring is provided as an elastically deformable elastic body, a head return means is provided for holding the shaving head at an initial position in an unloaded state, that is, a state in which an external force is not applied, and the shaving head is returned to the initial position with respect to the main body grip independent of the empty weight of the shaving head. Accordingly, since the shaving head is maintained at the original position with respect to the main body grip even if the main body grip is set horizontally in the case of applying the top portion of the shaving head to the cheek or an upper lip, it is easy to apply the top portion of the shaving head and a good usability is obtained.

However, in Japanese Patent Application Laid-Open No. 6-335575, it is necessary to make the rotation moment force equal to or more than a force opposing to the moment around the rotating shaft on the basis of the empty weight of the shaving head. Accordingly, a great elastic force is necessary in the helical torsion coil spring, and a rigidity of the helical torsion coil spring becomes high. In other words, since the moment of rotation for returning the shaving head becomes maximum at a time of setting the main body grip horizontally, and the stronger spring force of the helical torsion coil spring is required, the shaving head is hard to be rotated with respect to the rotating shaft at a time of applying the shaving head to the skin so as to get a shave, and there is a problem that it is hard to follow an irregularity of the skin, therefore, a plurality of outer blade portions are not brought into contact with the skin, it is impossible to shave short, and an unshaved portion is left.

Further, since the moment of rotation for rotating with respect to the rotating shaft is large, it is necessary to apply more force to the main body grip for making a plurality of outer blade portions follow at a time of shaving in a direction from the upper lip to the lips so as to strongly press to the skin, it is hard to move the shaving head, and there is a problem that the shaving head does not smoothly slip on the skin.

Further, if the helical torsion coil spring for returning is weakened or the helical torsion coil spring is detached due to the problem mentioned above, the load is strongly applied to the skin from the outer blade portion in a lower side of a plurality of outer blade portions of the shaving head on the basis of the moment of rotation caused by the empty weight of the shaving head by setting the main body grip horizontally at a time of shaving the cheek, the upper lips, and the outer blade portion in an upper side corresponding to the top portion is only weakly applied, so that there is a problem that it is impossible to shave short, and the unshaved portion is left due to a non-contact with the skin.

DISCLOSURE OF INVENTION

The present invention is made by taking the conventional problem mentioned above into consideration, and an object of the present invention is to provide a hair removing device in which a body hair treatment head is hard to be affected by its own weight, the body hair treatment head can maintain a predetermined incline and can be easily applied to a skin at every skin applying angle, the body hair treatment head is smoothly rotated at every angle of main body grip, the body hair treatment head is movable at a small moment of rotation with respect to an irregularity of the skin, a blade portion of the body hair treatment head can be smoothly followed, and it is possible to smoothly and securely remove the hair.

In other words, an object of the present invention is to provide a hair removing apparatus which is less affected by its own weight of the body hair treatment head in the rotation of the body hair treatment head, and can smoothly follow a blade portion of the body hair treatment head.

In order to achieve the object mentioned above, in accordance with a first aspect of the present invention, there is provided a hair removing apparatus comprising: a body hair treatment head removing a body hair by shaving the body hair, depilating the body hair or cutting the body hair; a main body grip held by a hand; and the body hair treatment head being rotatably coupled to the main body grip in such a manner that the body hair treatment head is freely oscillated with respect to the main body grip, wherein the hair removing apparatus is provided with a weight applying means for applying a force opposing to a force by which the body hair treatment head is oscillated by its own weight of the body hair treatment head around a center of rotation of the body hair treatment head.

In accordance with the structure mentioned above, the body hair head is not affected by its own weight or can be less affected, and it is possible to maintain a weight balance at every angle of an incline of the body hair treatment head. Further, the body hair treatment head is hard to be affected by its own weight at every grip angle and can be smoothly rotated. Accordingly, it is possible to make the blade portion of the body hair treatment head smoothly follow to the skin, and it is possible to smoothly and securely remove the hair.

Further, in accordance with a second aspect of the present invention, in the invention as recited in the first aspect, the weight applying means is installed to the main body grip side. The weight applying means is easily provided by installing the weight applying means to the main body grip side, and the structure can be made simple and inexpensive.

Further, in accordance with a third aspect of the present invention, in the invention as recited in the first or second aspect, a weight applying member serving as the weight applying means is installed rotatably to the main body grip side, an applied weight is provided in one side of the weight applying member with respect to a center of rotation of the weight applying member and the other side is coupled to the body hair treatment head. In this case, whatever direction the body hair treatment head is rotated around the center of rotation, the weight applying member follows, and it is possible to make the blade portion of the body hair treatment head smoothly follow to the skin.

Further, in accordance with a fourth aspect of the present invention, in the invention as recited in any one of the first to third aspects, a weight applying member serving as the weight applying means is provided in a side portion of the body hair treatment head in a direction orthogonal to a direction in which the body hair treatment head is oscillated. Since the weight applying member is arranged in the side portion of the body hair treatment head, it is possible to make the body hair treatment head close to the main body grip even if the weight applying member is provided, whereby it is possible to shorten a length of the hair removing device.

Further, in accordance with a fifth aspect of the present invention, in the invention as recited in any one of the first to fourth aspects, in the case that the body hair treatment head side is set to an upper side and the main body grip side is set to a lower side, a weight applying member serving as the weight applying means is provided in a lower side of the body hair treatment head. In this case, it is possible to reduce a width of the hair removing device corresponding to a direction orthogonal to the direction in which the body hair treatment head is oscillated.

Further, in accordance with a sixth aspect of the present invention, in the invention as recited in any one of the first to fifth aspects, a force of rotation moment applied so as to oppose to a moment of rotation of the body hair treatment head by a weight applying member serving as the weight applying means is made equal to or smaller than a force of rotation moment generated by the body hair treatment head around a center of rotation of the body hair treatment head. In this case, it is possible to make a relative weight of the weight applying member small, and it is possible to make the weight small, whereby it is possible to downsize the hair removing apparatus.

Further, in accordance with a seventh aspect of the present invention, in the invention as recited in any one of the first to sixth aspects, a weight applying member serving as the weight applying means is provided in the main body grip side, and a force applied from the weight applying member is transmitted via a link. Even if the weight applying member is provided, the weight applying member does not form an obstacle to the rotation of the body hair treatment head, it is possible to smoothly rotate the body hair treatment head, it is possible to make a gravity point of the body hair treatment head close to the main body grip, and it is possible to improve a holding property, a moving property and a usability.

Further, in accordance with an eighth aspect of the present invention, in the invention as recited in any one of the first to seventh aspects, the body hair treatment head has a motor driving for removing hair. In this case, a rotation of the body hair treatment head by a drive transmission structure from the motor to the body portion of the body hair treatment head is not limited, it is possible to secure an angle of rotation of the body hair treatment head large, and it is easy to follow to the skin.

Further, in accordance with a ninth aspect of the present invention, in the invention as recited in any one of the first to eighth aspects, the hair removing apparatus is constituted by an electric shaver, the body hair treatment head is constituted by a shaving head having a blade comprising an outer blade for cutting the hair and an inner blade brought into inside contact with the outer blade so as to reciprocate, the shaving head is provided with a rotating shaft support portion of the shaving head in an end portion in the reciprocating direction of the inner blade, and a rotating shaft support portion of a weight applying member serving as the weight applying means is provided in a support table of the main body grip. In this case, even in a complicated tilting motion of the main body grip at a time of getting a shape from the cheek or the under jaw to the lips or the upper lip, the blade portion of the shaving head easily follows, and it is possible to get a shave short, and the unshaved portion is reduced.

Further, in accordance with a tenth aspect of the present invention, in the invention as recited in any one of the first to ninth aspects, a portion coupling a weight applying member serving as the weight applying means to the body hair treatment head is provided in an opposite side to the rotation support point of the body hair treatment head, with respect to the gravity point of the body hair treatment head. In this case, it is possible to make the force by which the weight applying member supports the body hair treatment head small, and it is possible to downsize the hair removing apparatus.

BRIEF DESCRIPTION OF DRAWINGS

FIGS. 22A and 22B show a seventh embodiment of the present invention, in which FIG. 22A is a schematic side elevational view and FIG. 22B is an exploded perspective view of a main portion.

BEST MODE FOR CARRYING OUT THE INVENTION

A description will be given below of the present invention on the basis of embodiments shown in the accompanying drawings.

First Embodiment

Figure 1:
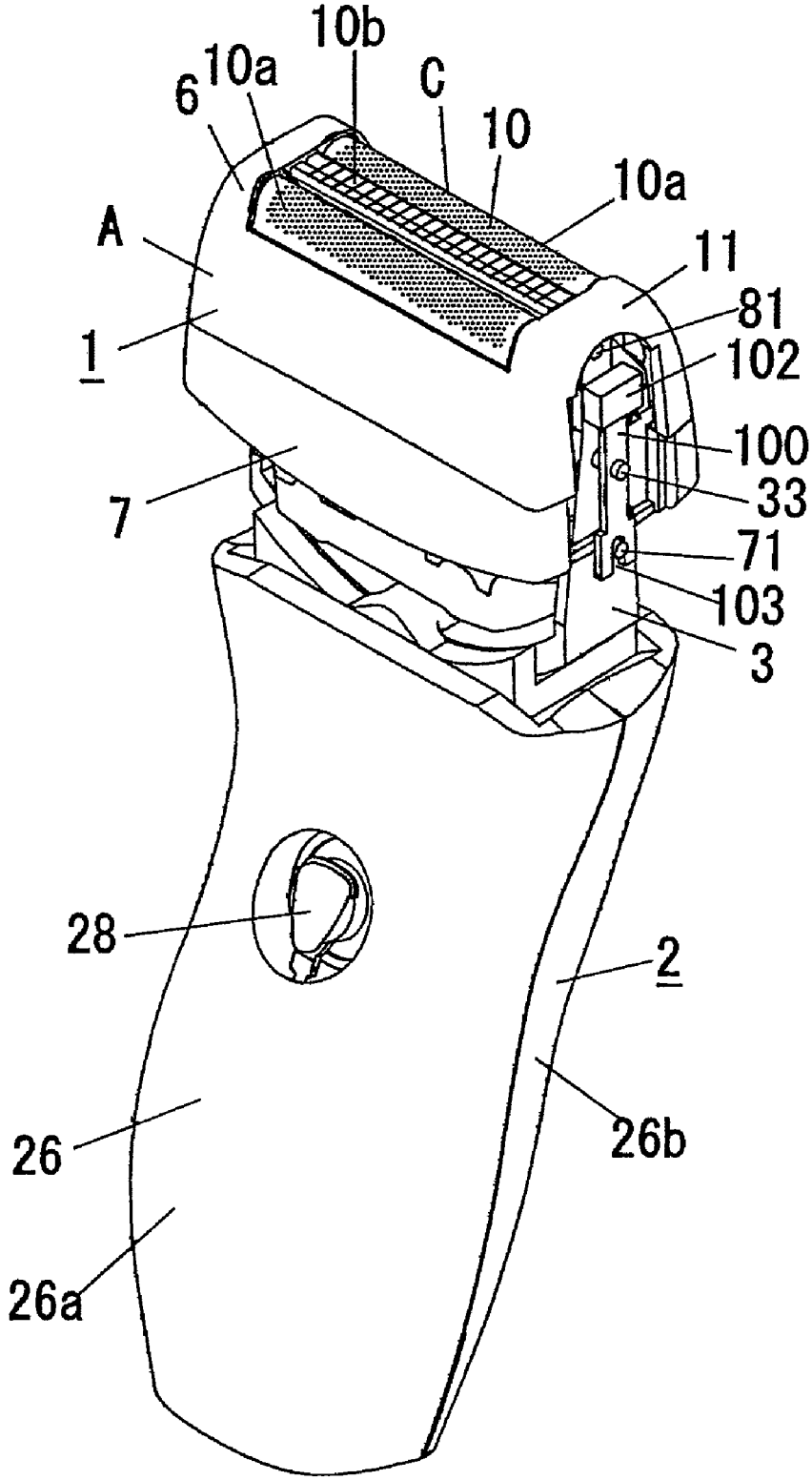
FIG. 1 is a perspective view showing a whole of an electric shaver in accordance with a first embodiment of the present invention.
Figure 2:
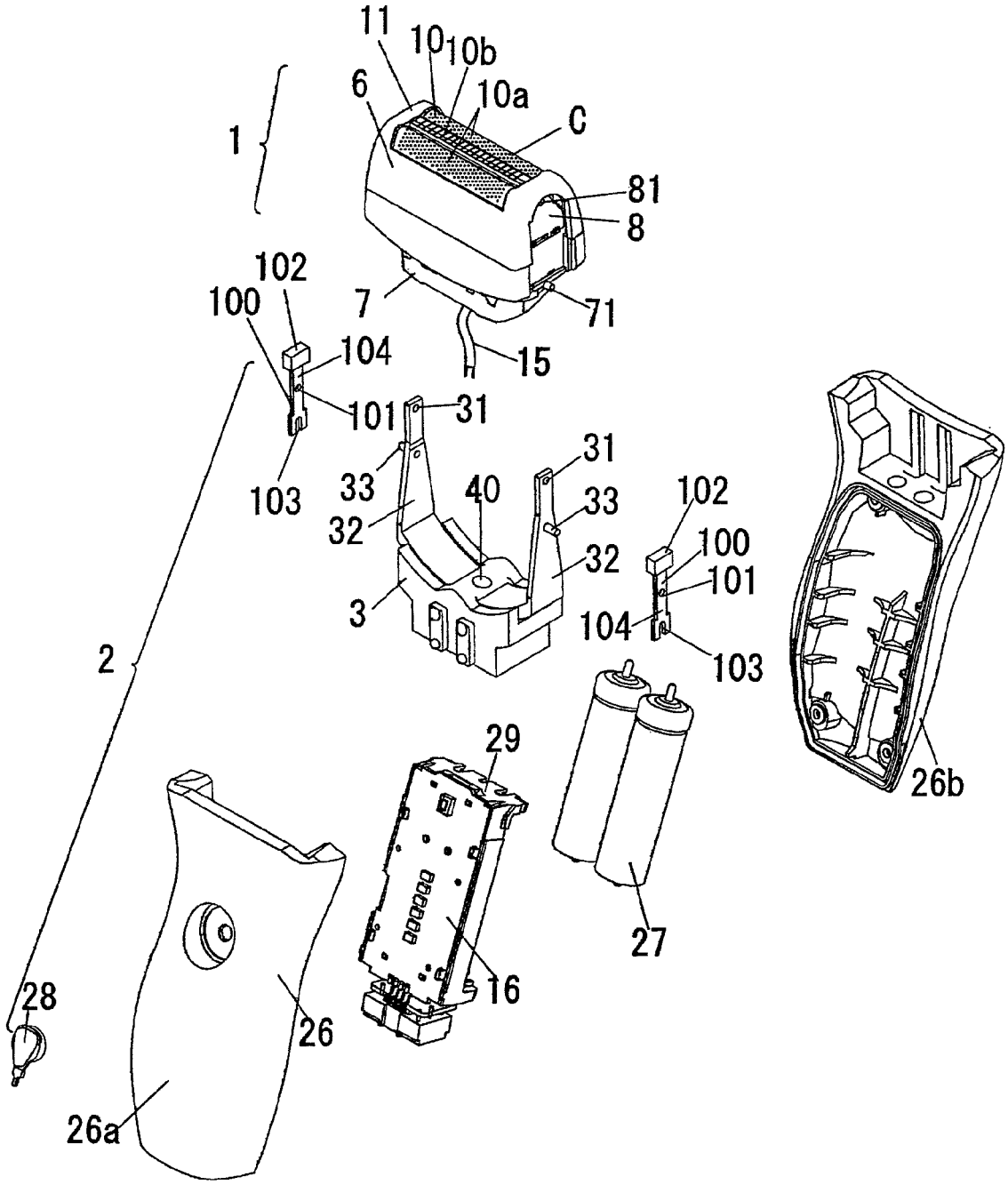
FIG. 2 is a perspective view obtained by exploding a main body grip in the first embodiment.

A first embodiment in accordance with the present invention is shown in FIGS. 1 to 8. In this case, a hair removing apparatus is constituted by an electric shaver, and a body hair treatment head A is constituted by a shaving head 1. The electric shaver is structured, as shown in FIGS. 1 and 2, such that a shaving head 1 having a blade surface C for getting a shave is arranged in one end portion of an elongated main body grip 2 forming a grip portion gripping an outer peripheral portion by a hand. In this case, on the assumption that one end portion close to the shaving head 1 in a longitudinal direction of the main body grip 2 is set to "upper side", and the other end portion in the longitudinal direction is set to "lower side", the shaving head 1 is arranged in an end portion in an upper side of the main body grip 2.

Figure 3:
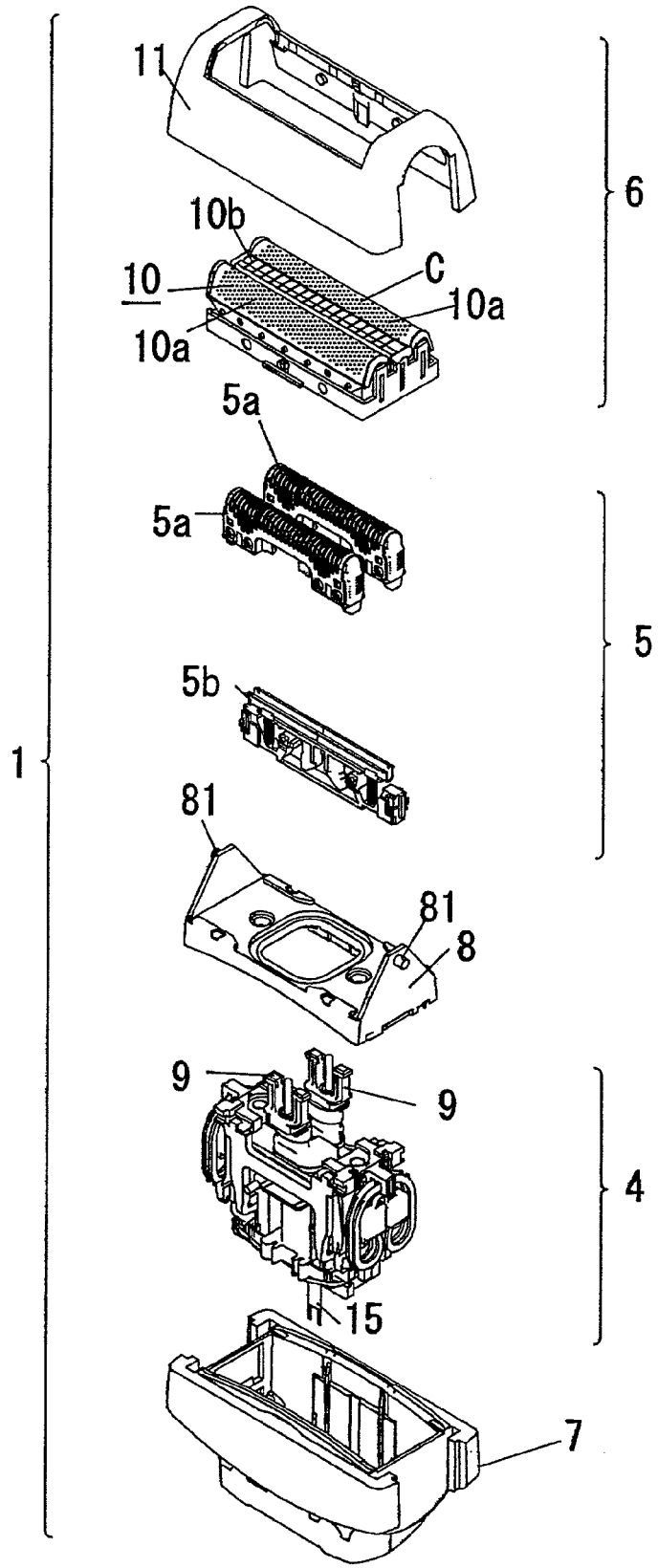
FIG. 3 is an exploded perspective view of a shaving head in the first embodiment.
Figure 4:
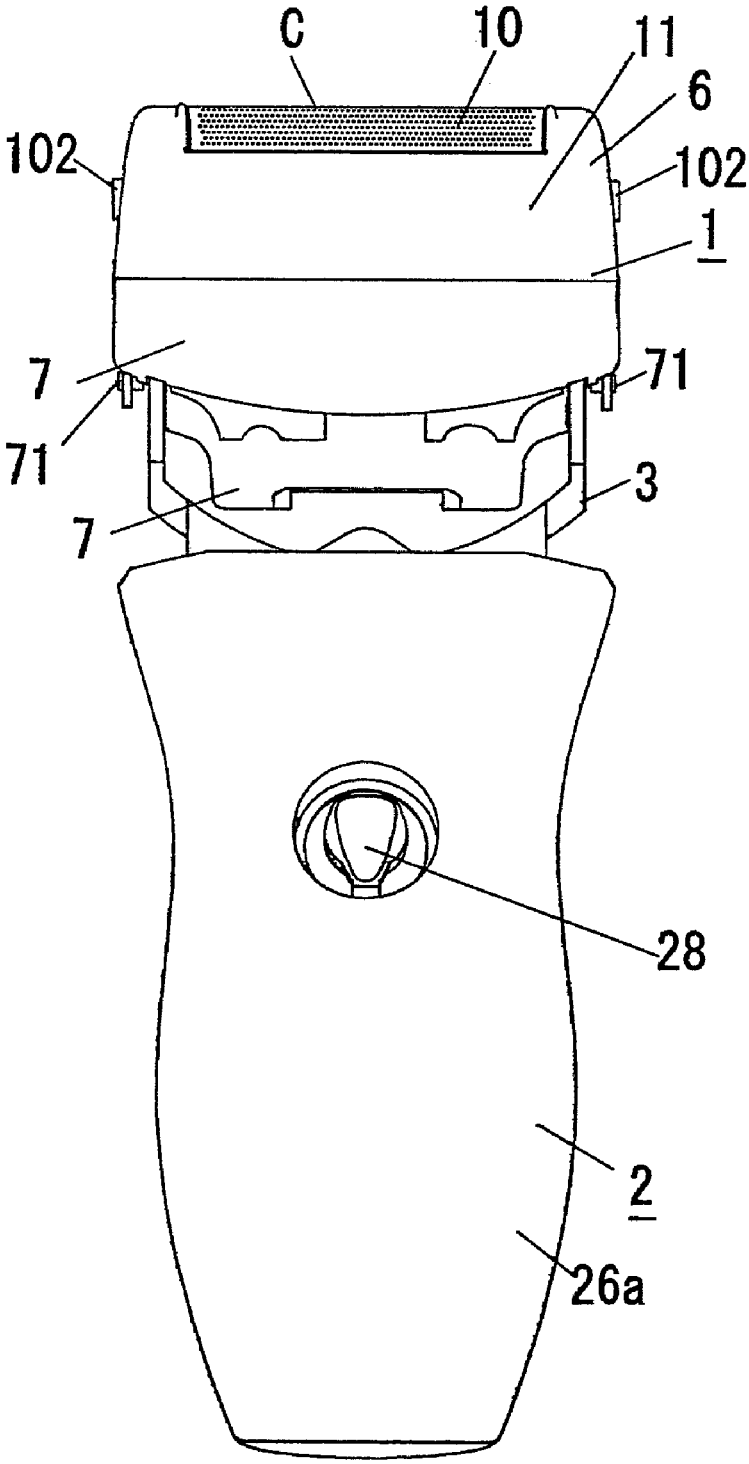
FIG. 4 is a front elevational view of an electric shaver in the first embodiment.
Figure 5:
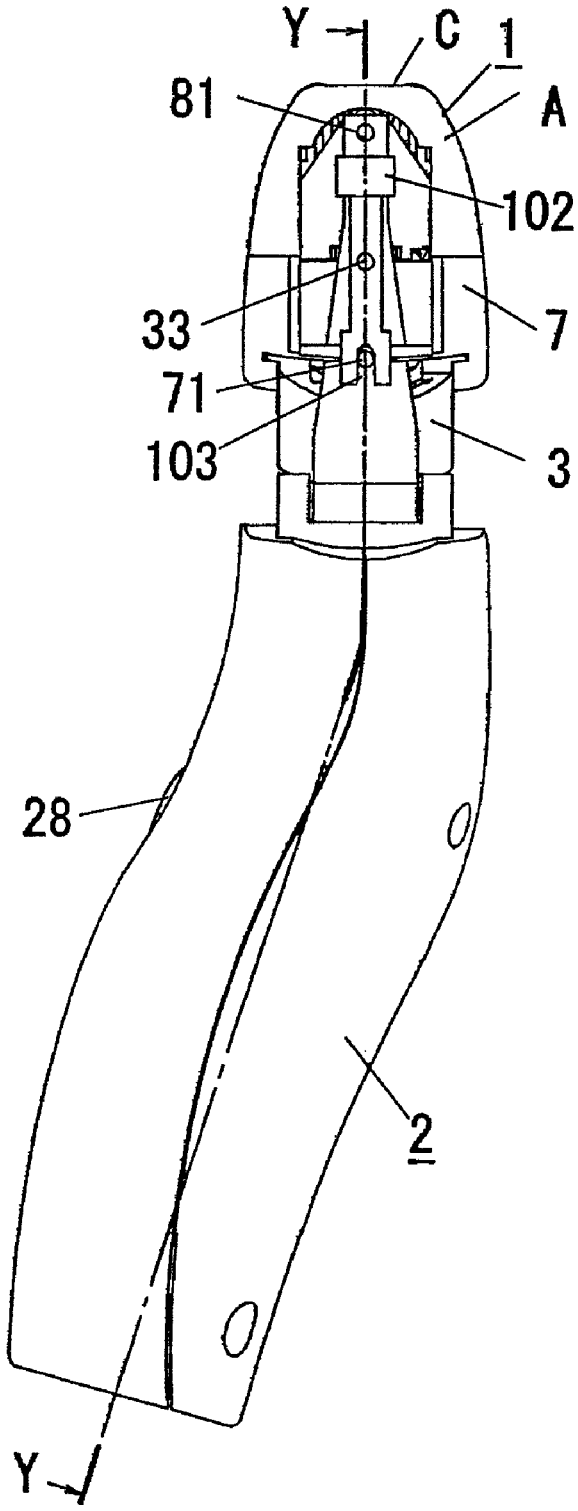
FIG. 5 is a side elevational view of the electric shaver in the first embodiment.
Figure 6:
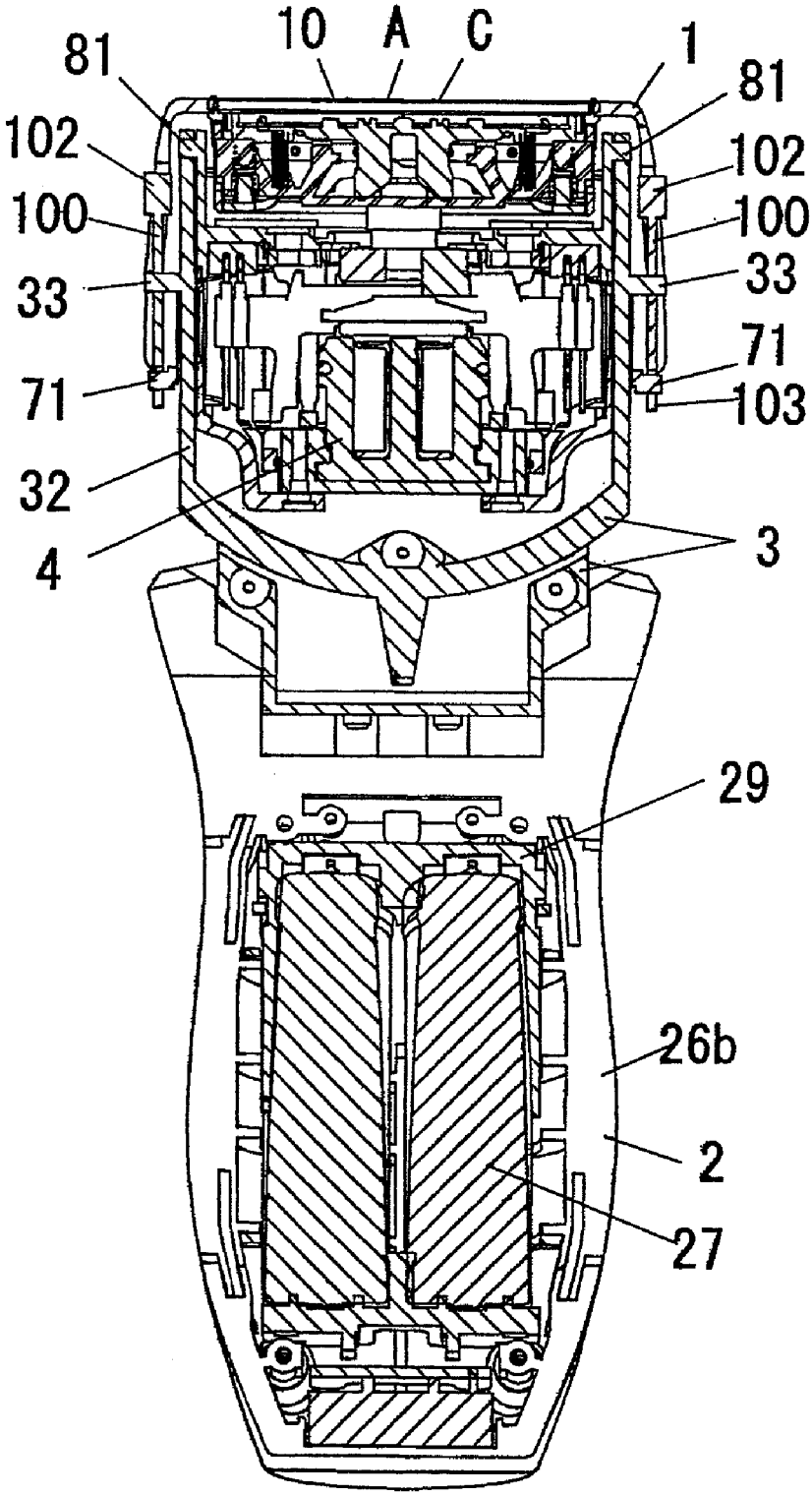
FIG. 6 is a cross sectional view along a line Y-Y in FIG. 5.

First, a description will be given of the shaving head 1 with reference to FIG. 3. The shaving head 1 is constituted by a motor 4 comprising a linear motor, an inner blade 5, an outer blade block 6, a head case 7 storing and holding the motor 4, and a head case cover 8. In the case that an oscillating direction of the motor 4 constituted by the linear motor (that is, a reciprocating direction of the inner blade 5) is defined as a right and left direction, the oscillation in the right and left direction is transmitted to the inner blade 5 by a drive element 9 in a leading end thereof, whereby the inner blade 5 is driven so as to reciprocate in the right and left direction, and cuts the hair entering into a blade hole provided in an outer blade 10 of the outer blade block 6. Further, an outer blade frame 11 holds the outer blade 10, and is detachably attached to the head case cover 8. In this case, in the following explanation, a description will be given by setting a direction orthogonal to both of an up and down direction and the right and left direction in accordance with the definition mentioned above to a back and forth direction.

The motor 4 constituted by the linear motor is inserted to an inner portion from an upper opening portion of the head case 7 so as to be inner installed, and is fixed by a screw (not shown) by putting the head case cover 8 on an upper opening portion of the head case 7 in a state in which the motor 4 is inner installed into the head case 7. A lower side of the motor 4 is fixed to the head case 7 by thread inserting a screw (not shown) from a lower side of the head case 7. As mentioned above, a drive block storing the motor within one casing constituted by the head case 7 and the head case cover 8 is structured by inner installing the motor 4 into the head case 7 as mentioned above and fixing in a state of being sandwiched by the head case 7 and the head case cover 8.

As shown in FIG. 2, a lead wire 15 extending from a lower side of the motor 4 is structured such that a leading end portion is coupled to a drive circuit 16 within the main body grip 2 for driving the motor 4, and the lead wire 15 passes through a hole 40 of a head support table 3 in a state of being exposed to a lower side through a hole provided in the head case 7, and is coupled to the drive circuit 16 within the main grip 2.

Three outer blades 10 are installed to the outer blade block 6 in such a manner as to be arranged side by side in the back and forth direction, and these outer blades 10 are constituted by a net blade 10*a*, a slit blade 10*b* and the net blade 10*a* alphabetically from the front side to the rear side. These outer blades 10 are held by a frame-shaped holding member (not shown) in such a manner as to be independently floatable. Further, the inner blade 5 is constituted by a blade 5*a*, a slit inner blade 5*b* and the blade 5*a*, and these blades are brought into slidable contact with the net blade 10*a*, the slit blade 10*b* and the net blade 10*a* so as to be driven by the drive element 9 in a reciprocating manner. Further, in the present embodiment, a blade surface C serving as an electric shaver is structured by the net blade 10*a*, the slit blade 10*b* and the net blade 10*a*. Accordingly, in the present embodiment, the blade surface C exists in an upper surface portion corresponding to a top surface of the shaving head 1.

Next, a description will be given of the main body grip 2. A main body grip case 26 constructing an outer shell of the main body grip 2 is structured such that an outer peripheral portion forms a grip portion, the main body grip case 26 is divided into a front main body grip case 26*a*, and a rear main body grip case 26*b*, and is formed as a box body in which a lower portion of the main body grip case 26 is sealed in a state of coupling the front and rear main body grip cases 26*a* and 26*b*, and a battery 27, the drive circuit 16, a switch button 28 and a base plate 29 supporting them are inner installed to an inner portion of the portion forming the box body in the lower portion of the main body grip case 26 so as to be fixed. The front and rear main body grip cases 26*a* and 26*b* are fixed by a thread (not shown) from a rear surface after incorporating the inner installed parts.

An upper side of an upper surface portion of the portion sealed in the box body shape in the lower portion of the main body grip case 26, that is, an upper portion of the main body grip case 26 is formed as a concave portion having an open upper side, and a head support table 3 for supporting the shaving head 1 is arranged and fixed to the concave portion. The head support table 3 may be structured such as to be attached to the main body grip 2 by a spring so as to be movable up and down.

The head support table 3 is formed in a U-shaped form provided in a protruding manner with uprising pieces 32 lapping over both right and left sides of the shaving head 1 respectively from both right and left ends, and is provided with holes 31 at right and left two positions of the upper end portions of the right and left uprising pieces 32. The head case cover 8 is provided with rotating shafts 81 at right and left two positions as seen from a front face, and a pair of right and left rotating shafts 81 are loosely fitted to the holes 31 of the head support table 3 rotatably, and are coupled in such a manner as to make the shaving head 1 rotatable in the back and forth direction with respect to the main body grip 2. At a time of using the electric shaver structured as mentioned above, the shaving is executed by gripping the grip portion of the main body grip 2 by a hand, and applying the blade surface C of the shaving head 1 to the skin.

Next, a description will be given of a weight applying means in accordance with the present invention. The uprising pieces 32 are provided in a protruding manner in both sides of the head support table 3 fixed to the main body grip 2 in such a manner that a whole shape is formed in the U-shaped form, and the projection 33 is provided in a protruding manner in an outer side of the uprising piece 32. A weight applying member 100 constituting the weight applying means is provided with a dead weight 102 having a weight for balancing in one end, has a rotational hole 101 in a center portion, and is provided with a long groove 103 in the other end. The rotational hole 101 of the weight applying member 100 is rotatably fitted to a projection 33 of the uprising piece 32 of the head support table 3, and the long groove 103 of the weight applying member 100 is engaged with a boss rib 71 provided in the head case 7 of the shaving head 1 which is set rotatable with respect to the main body grip 2 so as to be coupled.

It is preferable that the dead weight 102 having the weight for balancing provided in the weight applying member 100 is constituted by a metal material having a large specific gravity, an arm portion 104 of the weight applying member 100 is constituted by a molding material having a small specific gravity, and a weight for balancing is provided in such a manner as to enlarge a weight difference even if a volume of the weight applying member 100 is small. Further, the structure may be made such that the weight 102 and the arm portion 104 are constituted by the same material, and a biased weight is provided in an opposite side to the long groove 103 with respect to the rotational hole 101 in such a manner as to correspond to the dead weight 102. In this case, a number of parts is reduced, and the weight applying member 100 can be inexpensively structured.

In the embodiment shown in the drawing, the weight applying member 100 is provided in both the right and left sides of the shaving head 1, however, may be provided only in one of both the right and left sides of the shaving head 1. In accordance with this structure, it is possible to further reduce the number of the parts, and the cost becomes inexpensive. In the case that the weight applying member 100 is provided in one side as mentioned above, the weight applying member 100 may be provided at any of the right and left positions of the shaving head 1.

Figure 7:
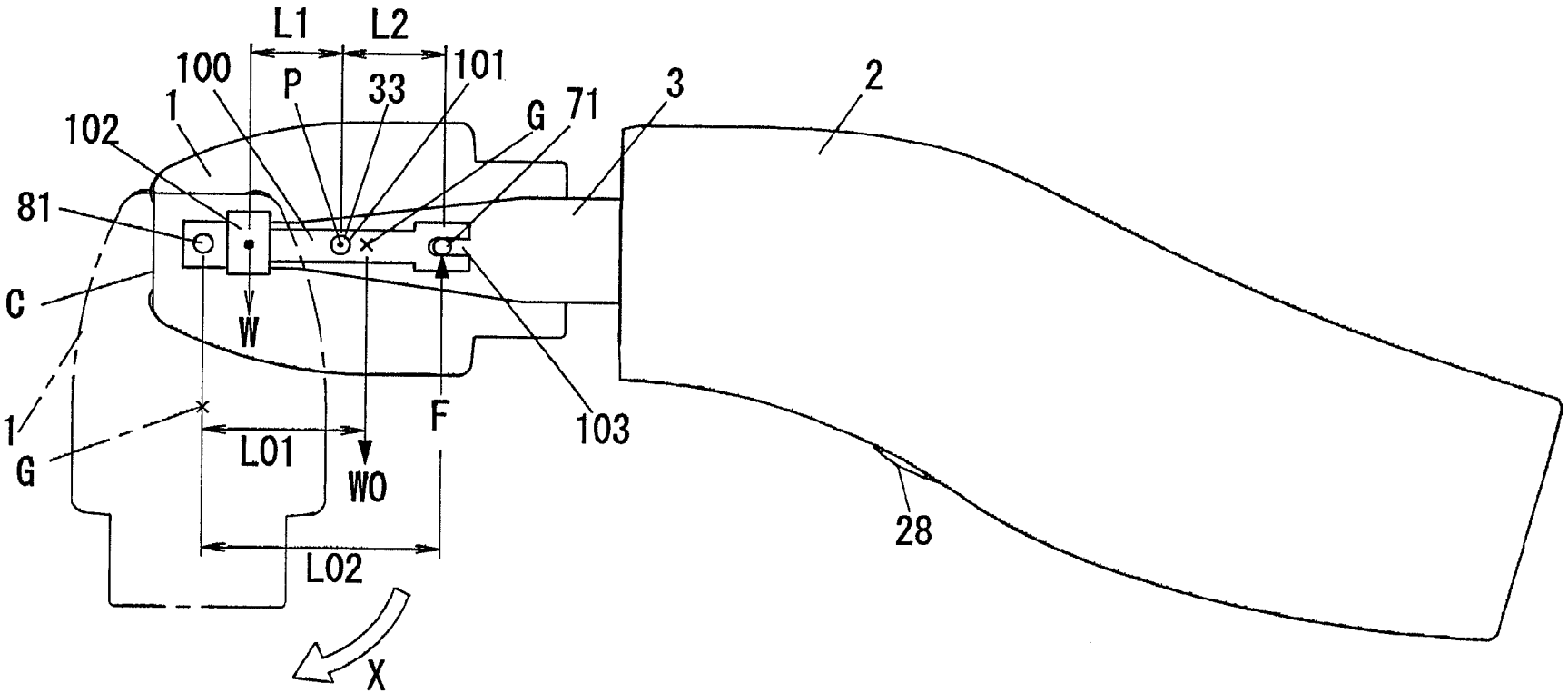
FIG. 7 is a schematic side elevational view explaining an operation of the first embodiment.

FIG. 7 is a schematic view showing a state at a time of setting the main body grip 2 horizontally and holding the main body grip 2 by the hand. A description will be given of an effect and an operation of the weight applying member 100 with reference to FIG. 7. At this time, the description will be given by assuming two weight applying members 100 in both the right and left sides as one for making the explanation simple.

The weight applying member 100 structured as mentioned above is rotated around the projection 33 serving as the rotating shaft, generates a couple of force of a rotation moment M on the basis of a weight W in accordance with a gravity of the dead weight 102 (or a biased weight) and a detached distance L1 at a time when the dead weight 102 is detached from a vertical direction passing through a center P of the projection 33, and is structured such that a force F in an opposite direction to the dead weight W is applied to a boss rib 71 of the head case 7 from an inner side surface of the long groove 103 of the weight applying member 100 at a magnitude corresponding to a distance L2 between the center P and the boss rib 71. In this case, in the case of excluding a friction in an engagement portion between the long groove 103 and the boss rib 71, an expression F=WL1÷L2=WL1/L2 is established.

Further, a rotating shaft 81 of the head case cover 8 is rotatably coupled to the hole 31 of the uprising piece 32 of the head support table 3, and the shaving head 1 is coupled to the main body grip 2 so as to be rotatable around the rotating shaft 81. At this time, the shaving head 1 has a gravity W0 in a gravity point G, and on the assumption that a distance from a vertical line passing through the center point of the rotating shaft 81 to the gravity point G is set to L01, the shaving head 1 is rotated downward on the basis of a moment of rotation M01=W0×L01 around the rotating shaft 81 if the weight applying member 100 is not provided. However, the force is applied to the shaving head 1 in the opposite direction to the gravity W0 on the basis of the force F generated by the weight applying member 100 in accordance with the present invention, and on the assumption that a distance between the rotating shaft 81 and the boss rib 71 is set to L02, a moment of rotation M02=F×L02 in the opposite direction to the moment of rotation M01 is applied to the shaving head 1, and the shaving head 1 maintains an inclined state. In the case that the weight applying member 100 is not provided, the shaving head 1 is rotated in a direction of an arrow X in FIG. 7 so as to come to a state shown by an imaginary line in FIG. 7.

At this time, the weight W of two dead weights 102 of these two weight applying members 100 is expressed by the following expressions.

In accordance with a balance expression, M01=W0×L01=M02=F×L02

$$F=W0\times L01\div L02=WL1/L2$$

In accordance with an expression Force F=WL1÷L2=WL1/L2

Weight W by gravity of two dead weights 102 W=W0×L01×L2÷L02÷L1

Accordingly, the shaving head 1 maintains its incline without being affected by the gravity at this time.

However, even if the weight W of two dead weights is smaller than the value mentioned above, the weight of the shaving head 1 is supported by two dead weights 102 on the basis of an opposite rotation moment to the rotation moment M01, and the shaving head 1 can be smoothly rotated around the rotating shaft 81.

As mentioned above, in the case that the weight W of two dead weights 102 is set equal or smaller as mentioned above, it is possible to make a whole weight of the electric shaver small and compact. In this case, since a friction exists due to the rotation of the shaving head 1 and the weight applying member 100 although being equal, the weight of these two dead weights 102 may be increased at about 20%.

Figure 8:
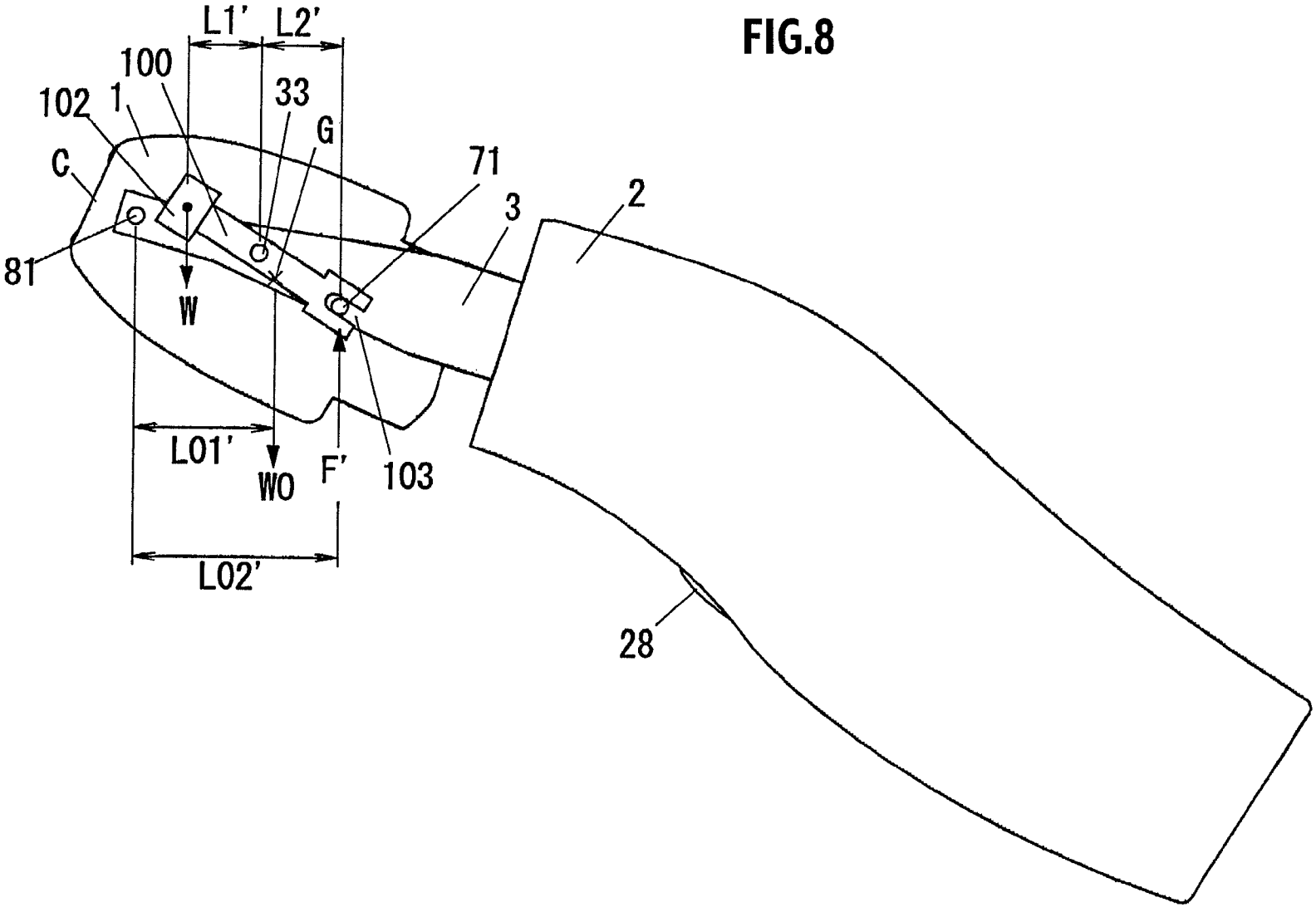
FIG. 8 is a schematic side elevational view explaining the other operation of the first embodiment.

FIG. 8 shows a schematic view at a time of holding by the hand in a state in which the shaving head 1 and the grip 2 are differently tilted. At this time it is possible to maintain the tilt without the shaving head 1 being affected by the gravity, by the weight applying member 100.

The balance at this time is expressed by W0×L0'=F'×L02', and F'=WL1'/L2'.

Further, the weight W by the gravity of two dead weights 102 is expressed by W=W0×L01'×L2'÷L02'÷L1

As mentioned above, in the weight applying member 100 in accordance with the present invention, in spite that the shaving head 1 is structured such as to be rotatable around the rotating shaft 81 close to the blade surface C with respect to the main body grip 2, the shaving head 1 can maintain the tilt without being affected by the gravity, can be smoothly rotated without being affected by the gravity around the rotating shaft 81 with respect to the main body grip 2, and has a good skin following performance particularly to the lips from the cheek and the lower jaw, a plurality of blade portions can uniformly press, it is possible to shave short and the unshaved portion is reduced.

Further, as is known from the matter mentioned above, since the weight W of the dead weight 102 can be freely set on the basis of the detached distance L1, the distance L2, the gravity W0, the distance L01 and the distance L02, it is possible to make the weight of the dead weight 102 small particularly by setting the distance L2 small and setting the distance L02 large, so that the electric shaver becomes compact.

Further, in the embodiment mentioned above, the description is given of the structure in which the long groove 103 is provided in the weight applying member 100, and the boss rib 71 is provided in the shaving head 1, thereby engaging the long groove 103 with the boss rib 71, however, the structure may be inversely made such that the boss rib 71 is provided in the weight applying member 100, and the long groove 103 is provided in the shaving head 1, thereby engaging the boss rib 71 with the long groove 103. Further, a long hole may be provided in place of the long groove 103. Further, in order to reduce the weight W and the volume of the dead weight 102 such as the embodiment mentioned above, it is preferable that the boss rib 71 is provided in an opposite side to the blade surface C with respect to the position of the gravity G.

Second Embodiment

Figure 9:
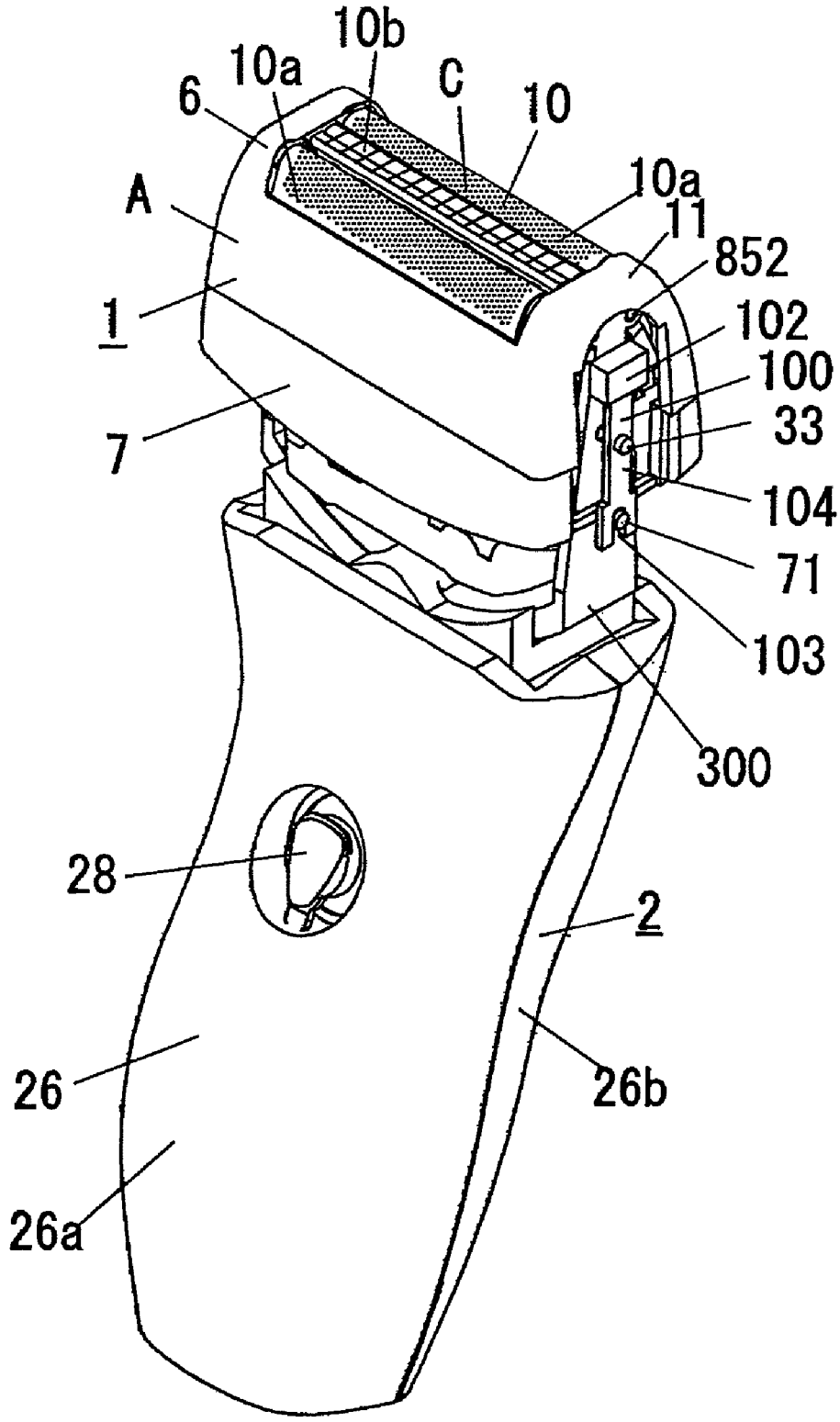
FIG. 9 is a perspective view showing a whole of an electric shaver in accordance with a second embodiment of the present invention.
Figure 10:
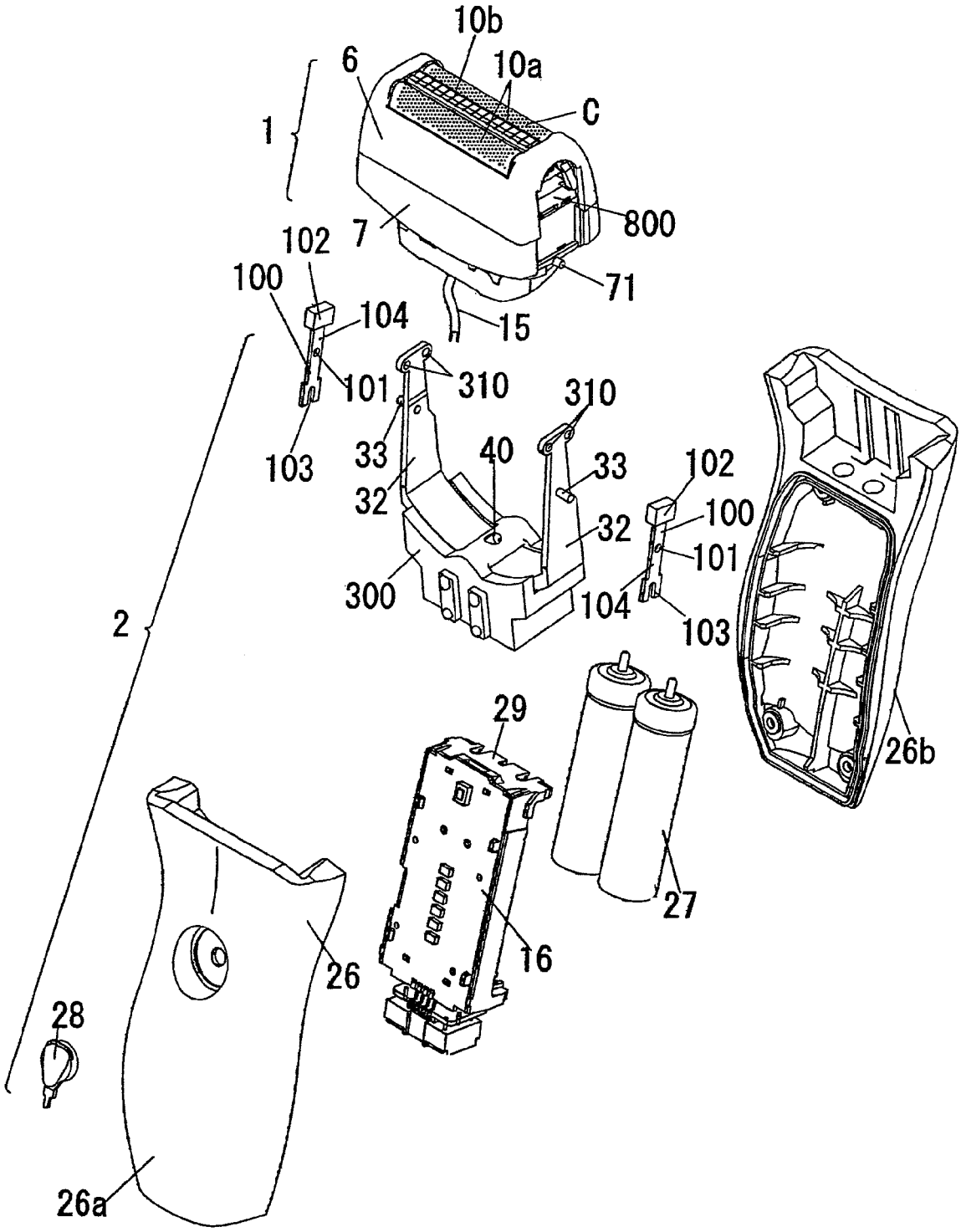
FIG. 10 is a perspective view obtained by exploding a main body grip in the second embodiment.
Figure 11:
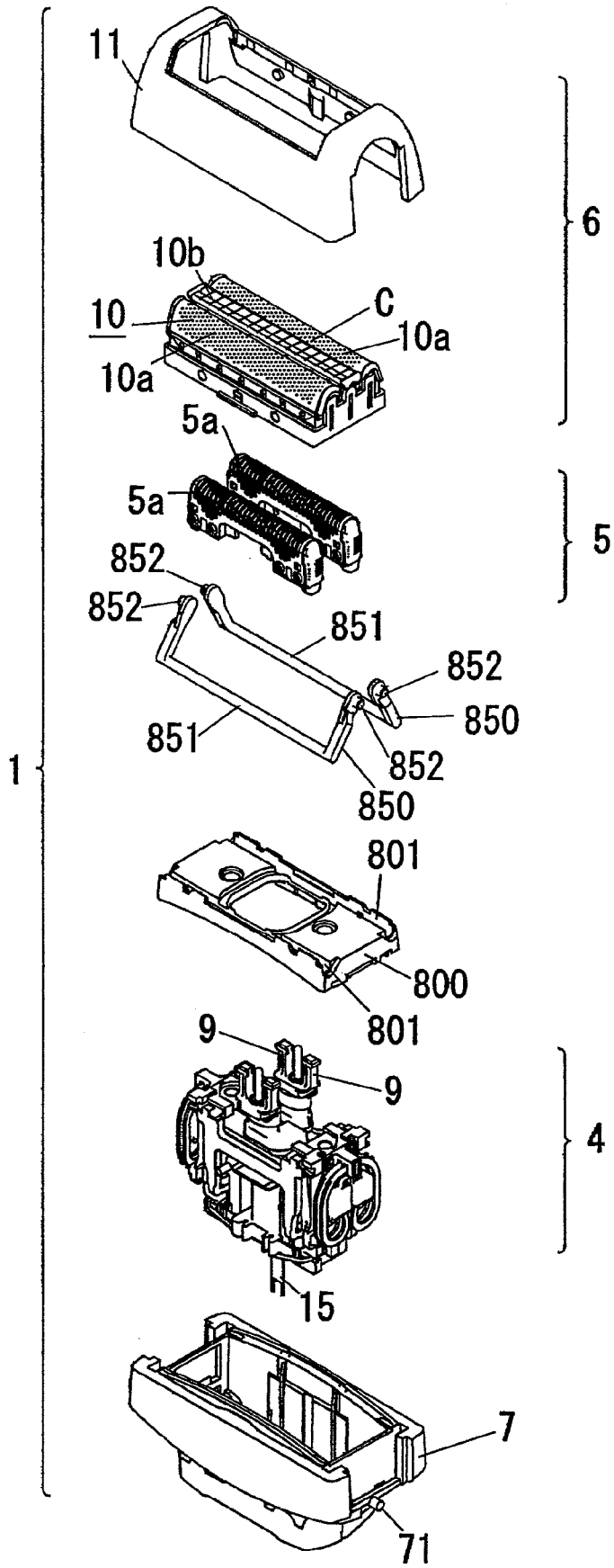
FIG. 11 is an exploded perspective view of a shaving head in the second embodiment.

Next, a description will be given of a second embodiment in accordance with the present invention with reference to FIGS. 9 to 11. The present embodiment is basically the same as the first embodiment, and is different only in a structure in which the shaving head 1 is rotatably supported to the main body grip 2.

First, a description will be given of a different point from the first embodiment of the shaving head 1 with reference to FIGS. 10 and 11. In place of the head case cover 8 in accordance with the first embodiment, a head case cover 800 and two link arms 850 are provided. Tow grooves 801 are provided in the head case cover 800, shaft portions 851 of a pair of link arms 850 are fitted to the groove 801, and a pair of link arms 850 are supported rotatably around the groove 801. The shaft portion 851 is engaged with the groove 801 so as to be prevented from coming off by a hook at a time of being fitted to the groove 801. A round boss 852 is provided in an upper end of the link arm 850.

A lower side of the motor 4 is fixed to the head case 7 by screwing a thread (not shown) from a lower side of the head case 7. A drive block incorporating the motor 4 within one box constituted by the head case 7 and the head case cover 800 is structured by inner installing the motor 4 within the head case 7 so as to fix in a state of being sandwiched by the head case 7 and the head case cover 800 as mentioned above.

Next, a description will be given of the main body grip 2. A head support table 300 for supporting the shaving head 1 is arranged in the main body grip 2 so as to be fixed. The head support table 300 is formed in a U-shaped form provided with the uprising piece 32 in a protruding manner along the right and left sides of the shaving head 1 from both right and left ends of the head support table 300, and is provided with holes 310 at every two right and left positions in upper ends of the right and left uprising pieces 32. The round boss 852 in the upper end of the link arm 850 rotatably installed to the head case cover 800 is rotatably fitted to each of the holes 310 and the link arm 850 is rotatably coupled, thereby rotatably coupling the shaving head 1 to the main body grip 2.

As mentioned above, in the second embodiment, the shaving head 1 is rotatable with respect to the main body grip 2 by two link arms 850, is not rotated at one point as is different from the first embodiment, but is rotated at two positions. Accordingly, it is possible to get an imaginary support point forming a center of rotation of the shaving head 1 close to the blade surface C by two link arms 850 or it is possible to set the imaginary support point in an upper side close to the blade surface C side, and it is further possible to smoothly rotate the shaving head 1.

A weight applying means in accordance with the second embodiment is structure in the same manner as the first embodiment. The uprising piece 32 is provided in a protruding manner in both sides of the head support table 3 fixed to the main body grip 2 in such a manner that a whole shape is formed in a U-shaped form, and the projection 33 is provided in a protruding manner in an outer side of the uprising piece 32. The weight applying member 100 constituting the weight applying means is provided with the deadweight 102 having a weight for balancing in one end, has the rotational hole 101 in a center portion, and is provided with the long groove 103 in the other end. The rotational hole 101 of the weight applying member 100 is rotatably fitted to the projection 33 of the uprising piece 32 of the head support table 3, and the long groove 103 of the weight applying member 100 is engaged with the boss rib 71 provided in the head case 7 of the shaving head 1 which is set rotatable with respect to the main body grip 2 so as to be coupled.

Further, in this case, the weight of the shaving head 1 is supported by two dead weights 102 in the same manner as the first embodiment, on the basis of the opposing rotation moment to the rotation moment M01, and the shaving head 1 can be smoothly rotated around the round boss 852.

As mentioned above, even if the rotational structure of the shaving head 1 is different with respect to the main body grip 2, the shaving head 1 can maintain the balance at an angle of every tilt of the shaving head 1 without being affected by the gravity, on the basis of the weight applying means in accordance with the present invention, the shaving head 1 can be smoothly rotated without being affected by the empty weight with respect to the main body grip 2 at every grip angle, it is possible to smoothly follow the blade portion of the shaving head 1 to the skin, it is possible to shave short and the unshaved portion is reduced.

Third Embodiment

Figure 12:
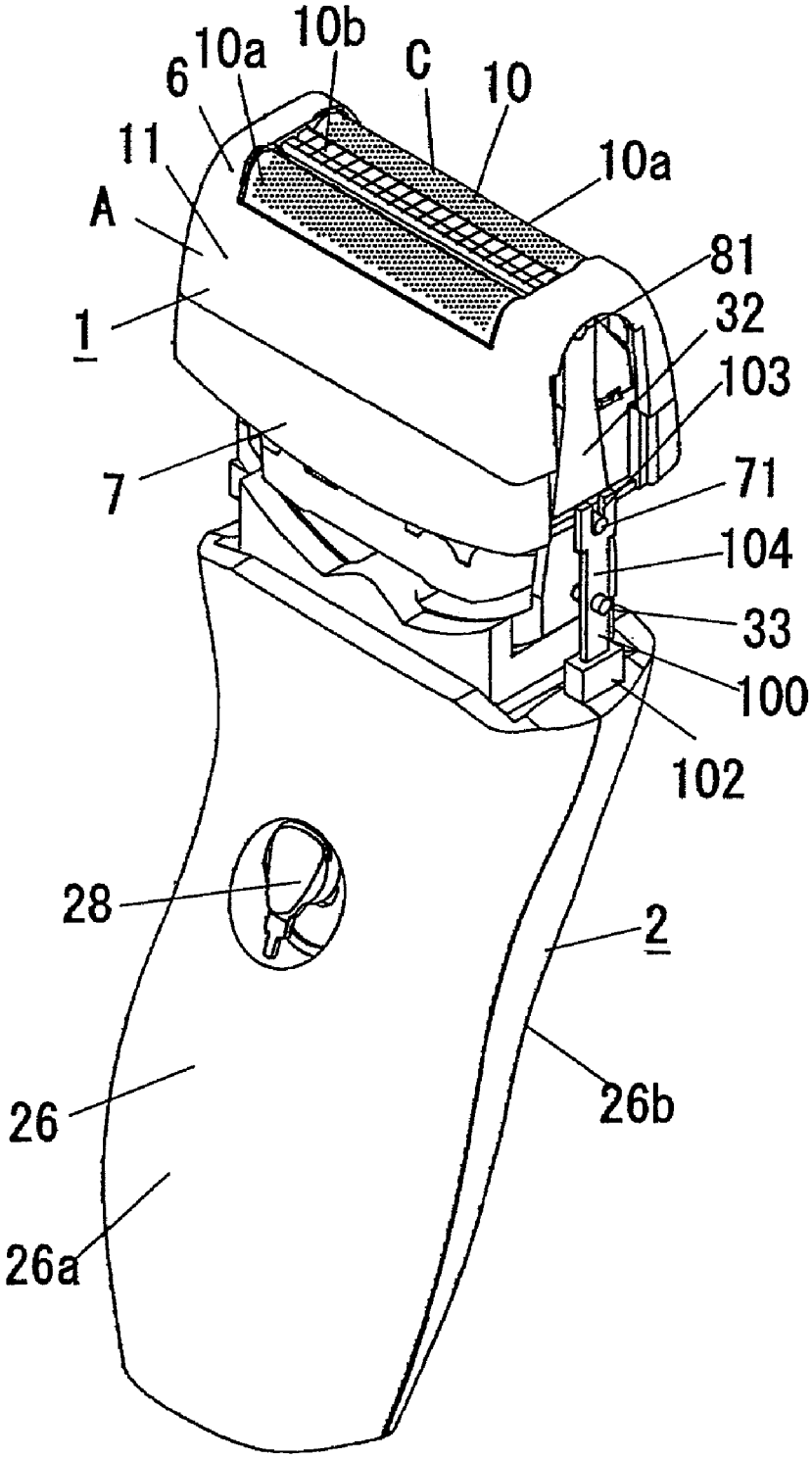
FIG. 12 is a perspective view showing a whole of an electric shaver in accordance with a third embodiment of the present invention.

Next, a description will be given below of a third embodiment with reference to FIGS. 12 and 13. The present embodiment is different only in a layout state of the weight applying member 100 serving as the weight applying means in the same manner as the first embodiment. A different point from the first embodiment exists only in a point that a direction in which the weight applying member 100 is attached is changed. The projection 33 provided in the uprising piece 32 of the head support table 3 and the boss rib 71 provided in the shaving head 1 are provided in a positional relation that the boss rib 71 is in an upper side and the projection 33 is in a lower side, the weight applying member 100 is arranged such that the dead weight 102 is in a lower side so as to fit the rotational hole 101 to the boss rib 71, and the long groove 103 is engaged with the projection 33 at a position above the projection 33.

Figure 13:
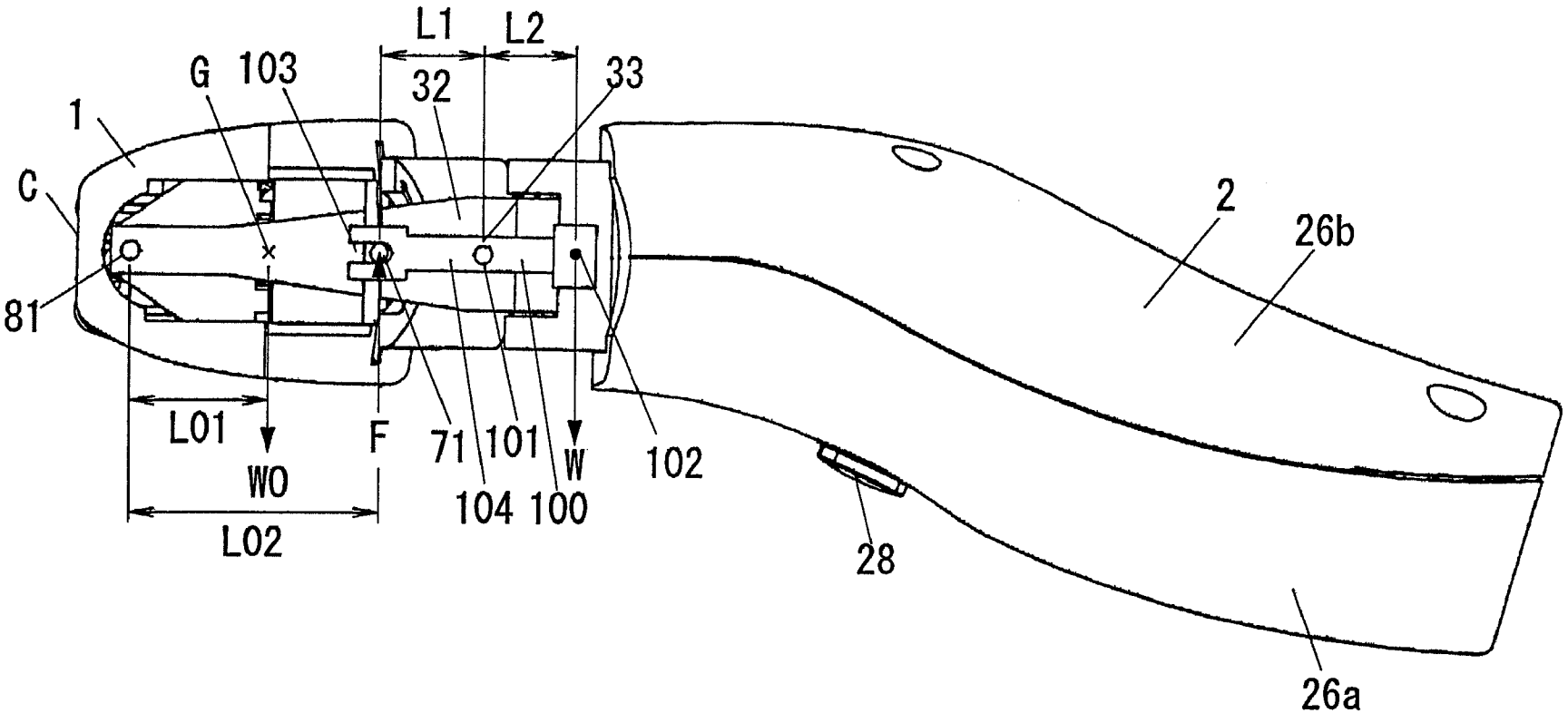
FIG. 13 is a schematic side elevational view explaining an operation of the third embodiment.

As shown in FIG. 13, in the same manner as the first embodiment, in accordance with a balance expression, there is obtained a relation M01=W0×L01=M02=F×L02, Accordingly, there is obtained a relation F=W0×L01÷L02=WL1/L2, in accordance with the expression F=WL1÷L2=WL1/L2, the weight W by the gravity of two dead weights 102 is obtained by the expression W=W0×L01×L2÷L02÷L1.

Accordingly, the shaving head 1 maintains the tilt without being affected by the gravity.

Further, such as the third embodiment, since the length in the longitudinal direction (the height in the up and down direction) of the shaving head 1 does not become long by arranging the dead weight 102 of the weight applying member in a lower side of the shaving head 1, it is easy to apply to the skin and a good usability is obtained. Further, in accordance with the structure mentioned above, it is possible to freely set the layout of the dead weight 102 of the weight applying member 100, the projection 33 and the boss rib 71. Further, describing a state in FIG. 13, the same effect can be obtained even by arranging the dead weight 102, the projection 33 and the boss rib 71 so as to be deviated from a horizontal line passing through the rotating shaft 81 up and down, and the same effect can be obtained even by arranging the dead weight 102 and the projection 33 diagonally to the horizontal line passing through the rotating shaft 81.

Fourth Embodiment

Figure 14:
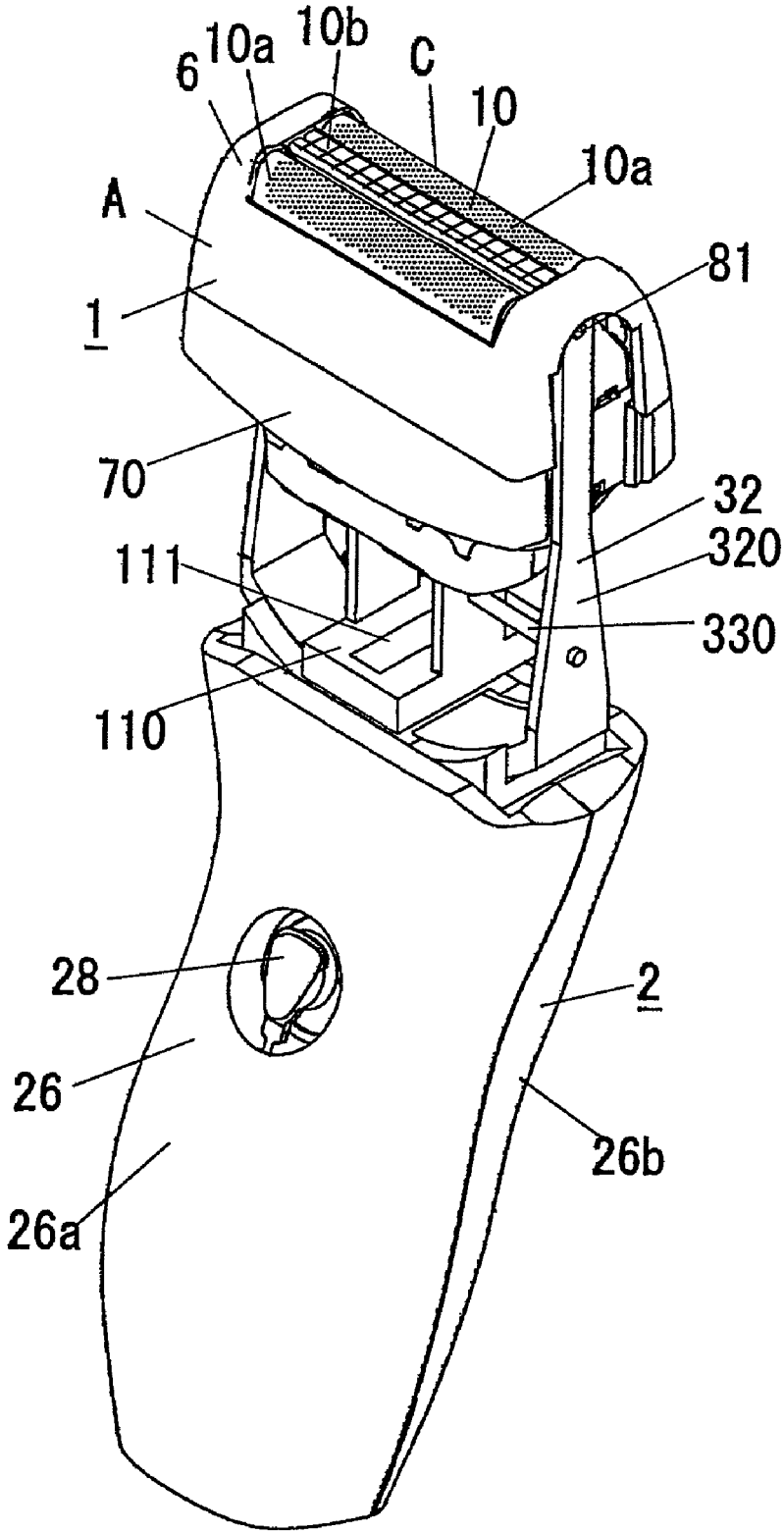
FIG. 14 is a perspective view showing a whole of an electric shaver in accordance with a fourth embodiment of the present invention.
Figure 15:
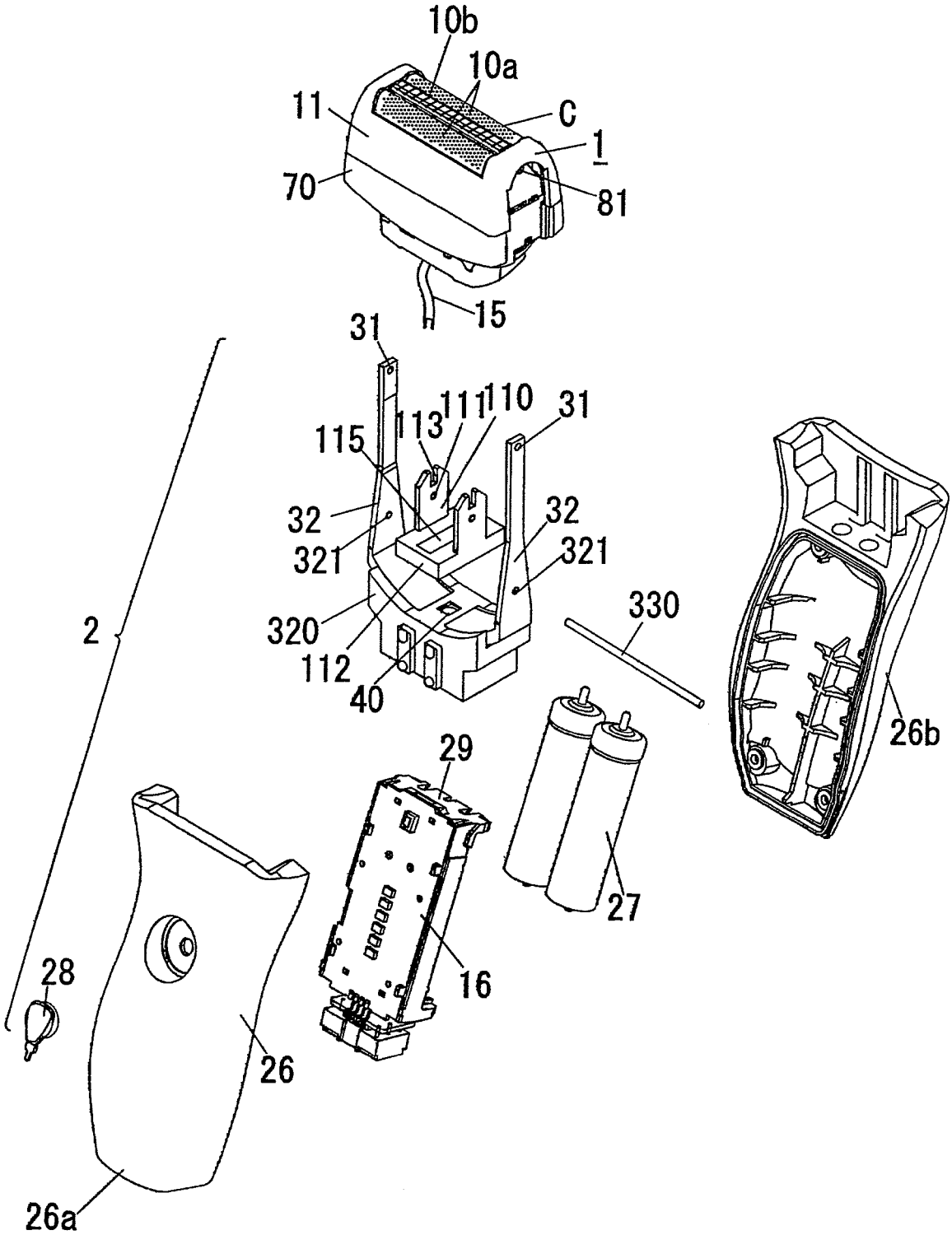
FIG. 15 is a perspective view obtained by exploding a main body grip in the fourth embodiment.
Figure 16:
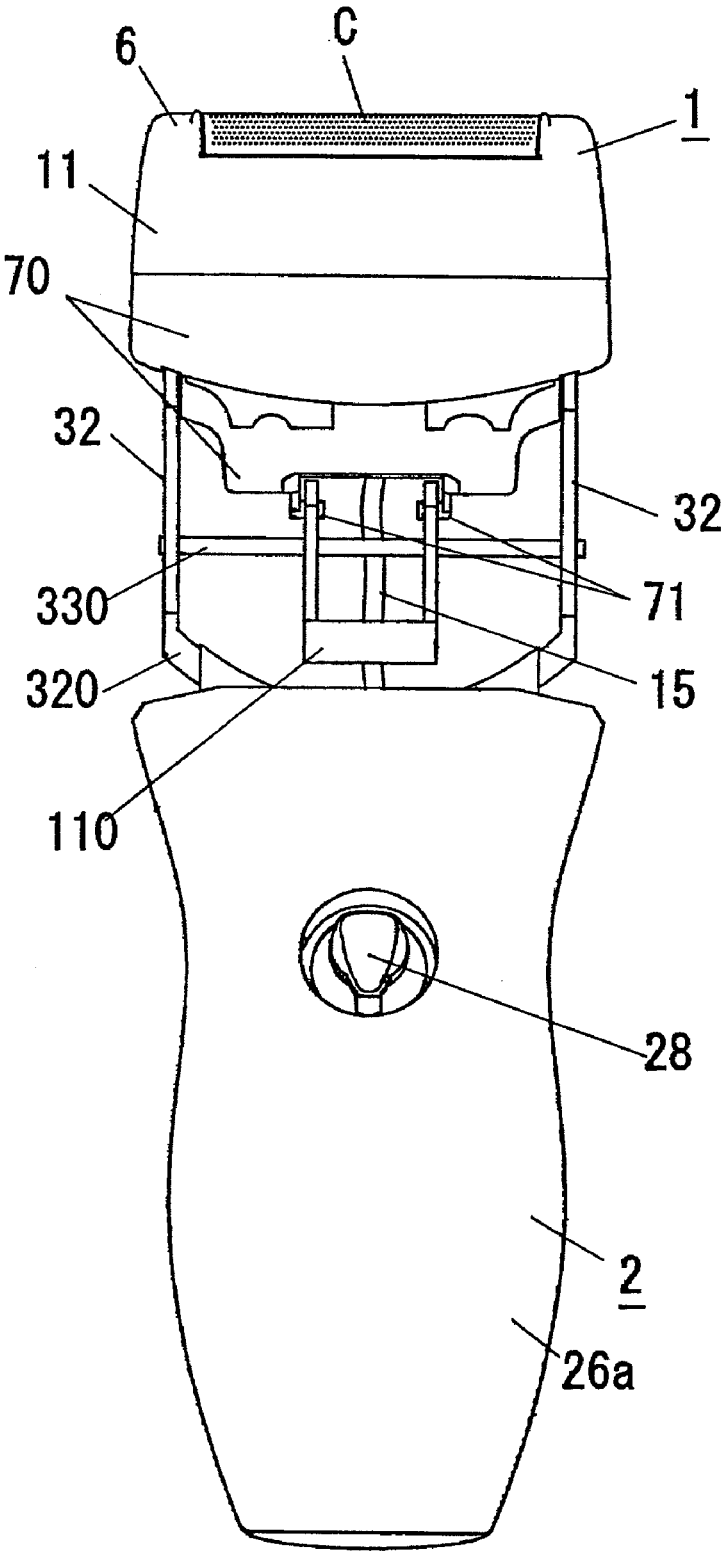
FIG. 16 is a front elevational view of the electric shaver in the fourth embodiment.

Next, a description will be given of a fourth embodiment in accordance with the present invention with reference to FIGS. 14 and 15. The present embodiment is basically the same as the first embodiment, and is different only in a state in which the weight applying member 110 serving as the weight applying means is provided. In other words, the weight applying member 110 is provided in an inner side between the right and left uprising pieces 32 of the a support table 320 in the lower side of the shaving head 1.

A hole 321 is provided in each of the right and left uprising pieces 32 of the head support table 320, the boss rib 71 is provided at the lower position of the shaving head 1 in the head case 70, a dead weight 112 of the weight applying member 110 is arranged so as to be below the hole 321, a shaft 330 is inserted to a rotational hole 111 of the weight applying member 110 and the hole 321 of the uprising piece 32 of the head support table 320 so as to be attached to the head support table 320, and the weight applying member 110 is rotatably installed to the shaft 330. Further, a long groove 113 is provided in the weight applying member 110, and the long groove 113 is slidably engaged with the boss rib 71 so as to be coupled. Further, a long hole 115 passing the lead wire 15 therethrough is provided in the dead weight 112 of the weight applying member 110.

Figure 17:
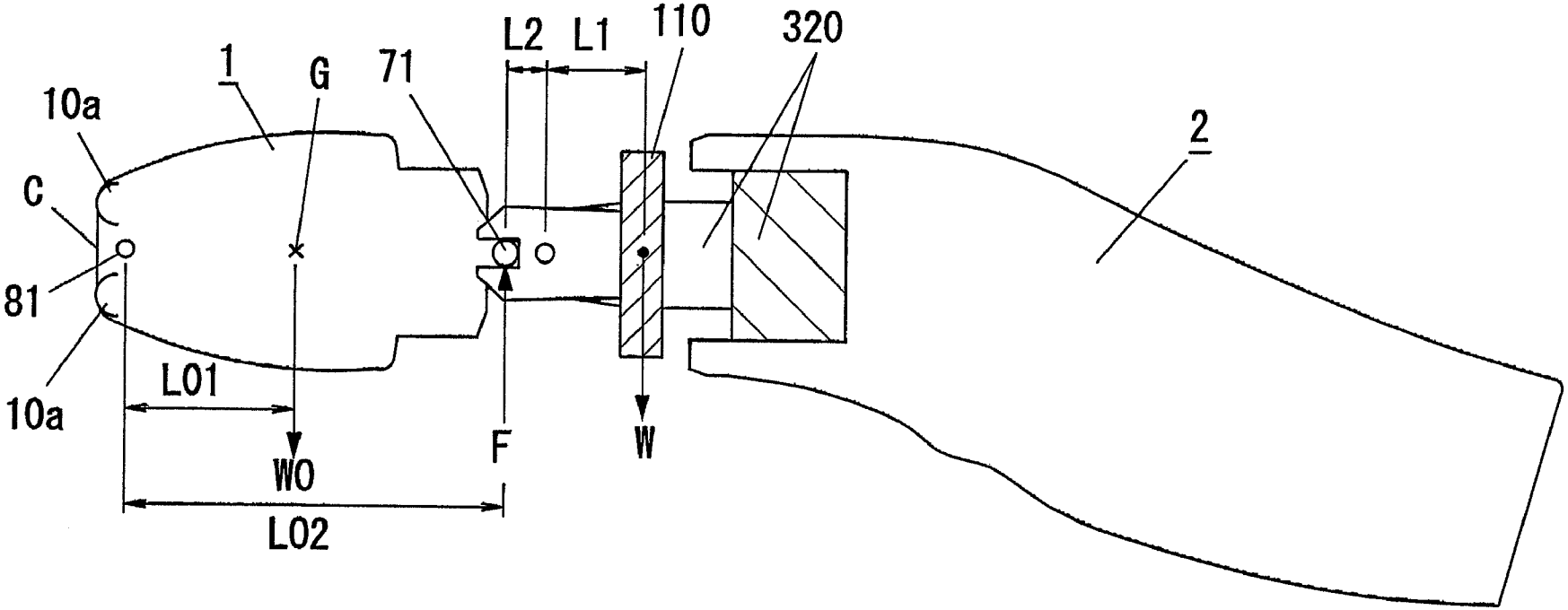
FIG. 17 is a schematic side elevational view explaining an operation of the fourth embodiment.

As shown in FIG. 17, in the same manner as the first embodiment, in accordance with a balance expression, there is obtained a relation M01=W0×L01=M02=F×L02.

Accordingly, there is obtained a relation F=W0×L01÷L02=WL1/L2, in accordance with the expression F=WL1÷L2=WL1/L2, the weight W by the gravity of two dead weights 102 is obtained by the expression W=W0×L01×L2÷L02÷L1.

Accordingly, the shaving head 1 maintains the tilt without being affected by the gravity.

Further, such as the fourth embodiment, since the length in the longitudinal direction (the height in the up and down direction) of the shaving head 1 does not become long by arranging the dead weight 112 of the weight applying member 110 in a lower side of the shaving head 1, and setting the weight applying member 110 in the inner side between the right and left uprising pieces 32 of the U-shaped head support table 320, it is easy to apply to the skin and a good usability is obtained. Further, since it is possible to enlarge the distance L02 between the rotating shaft 81 and the boss rib 71 with respect to the distance L01 from the vertical line passing through the center point of the rotating shaft 81 to the gravity point G and it is possible to make the force F small, it is possible to make the weight generated by the gravity of the dead weight 102, it is possible to make the dead weight 102 compact, it is possible to make the electric shaver compact and it is possible to improve a usability.

Figure 18:
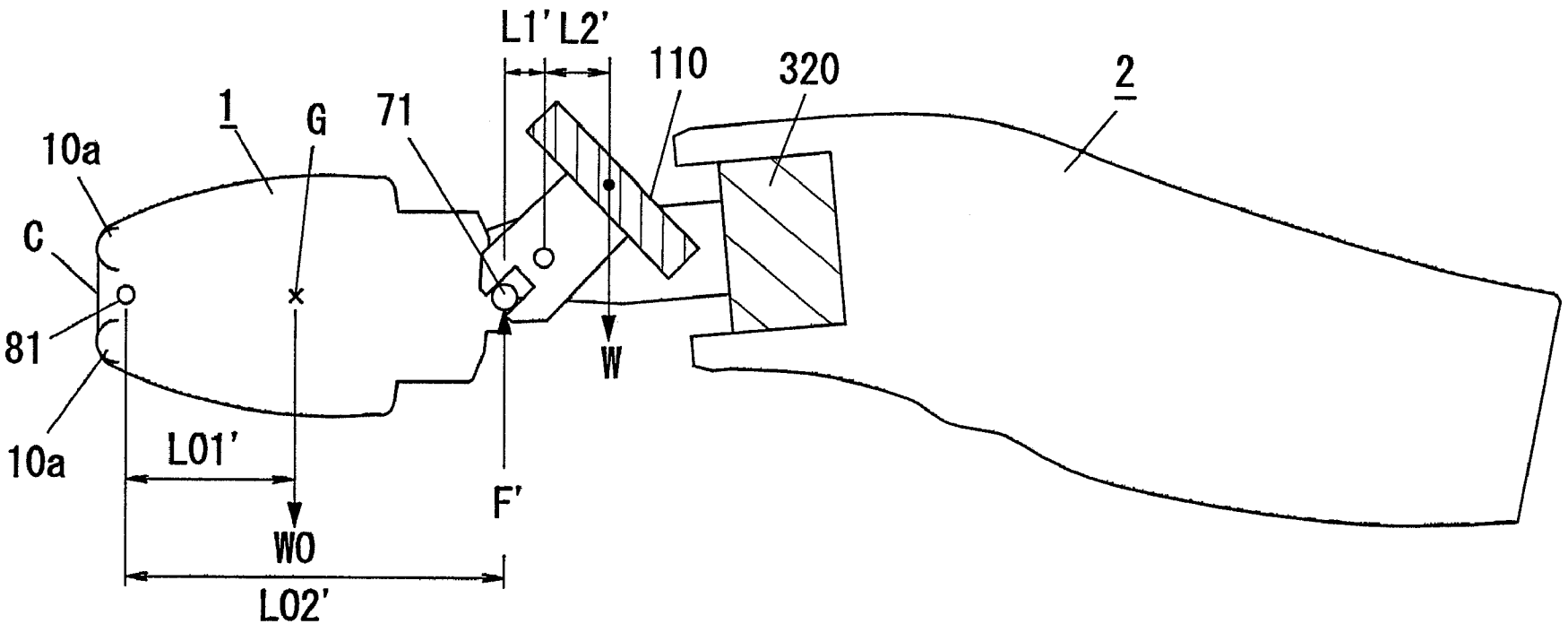
FIG. 18 is a schematic side elevational view explaining the other operation of the fourth embodiment.

Further, FIG. 18 shows a time when the shaving head 1 and the main body grip 2 are held by the hand in a state of being in the different tilts, however, in the same manner as FIG. 8 in accordance with the first embodiment, the shaving head 1 maintains the tilt without being affected by the gravity, by the weight applying member 110.

In other words, in the same manner as the structure shown in FIG. 8, the balance at this time is expressed by W0×L01'=F'×L02', there is obtained an expression F'=WL1'/L2', the weight W generated by the gravity of two dead weight 102 is obtained by the expression W=W0×L01'×L2'÷L02'÷L1'.

Further, in the fourth embodiment, it is possible to freely set the layout, the shape and the parts structure of the dead weight 112 of the weight applying member 110, the shaft 330 and the boss rib 71.

Fifth Embodiment

Figure 19:
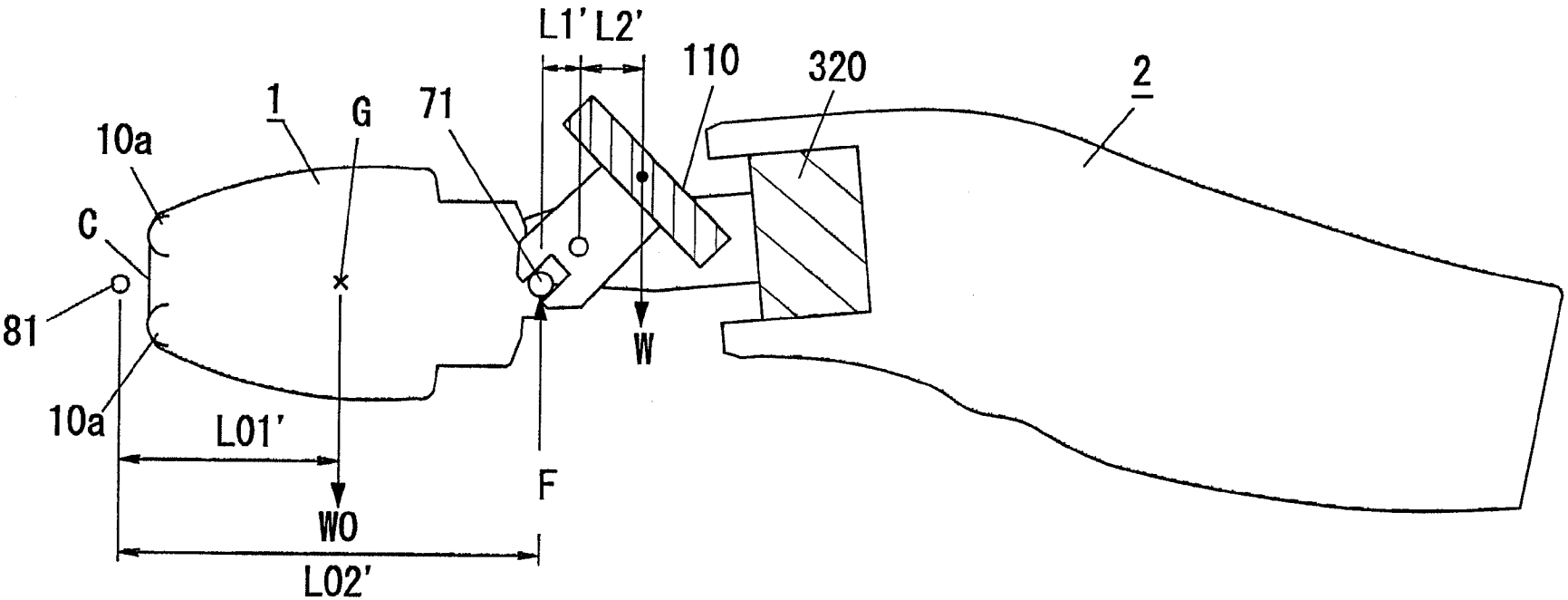
FIG. 19 is a schematic side elevational view explaining an operation of an electric shaver in accordance with a fifth embodiment of the present invention.

Next, a description will be given of a fifth embodiment with reference to FIG. 19. The present embodiment is basically the same as the fourth embodiment, however, is different in a position of the imaginary support point corresponding to the rotating shaft 81 of the shaving head 1. In other words, the imaginary support point serving as the rotating shaft 81 is provided in an upper side of the blade surface C. In this case, the balance expression is established in the same manner as the fourth embodiment, it is possible to maintain the tile without being affected by the gravity point even if the imaginary support point serving as the rotating shaft 81 is provided in the upper side of the blade surface C, and it is possible to obtain the same effect as mentioned above.

Sixth Embodiment

Figure 20:
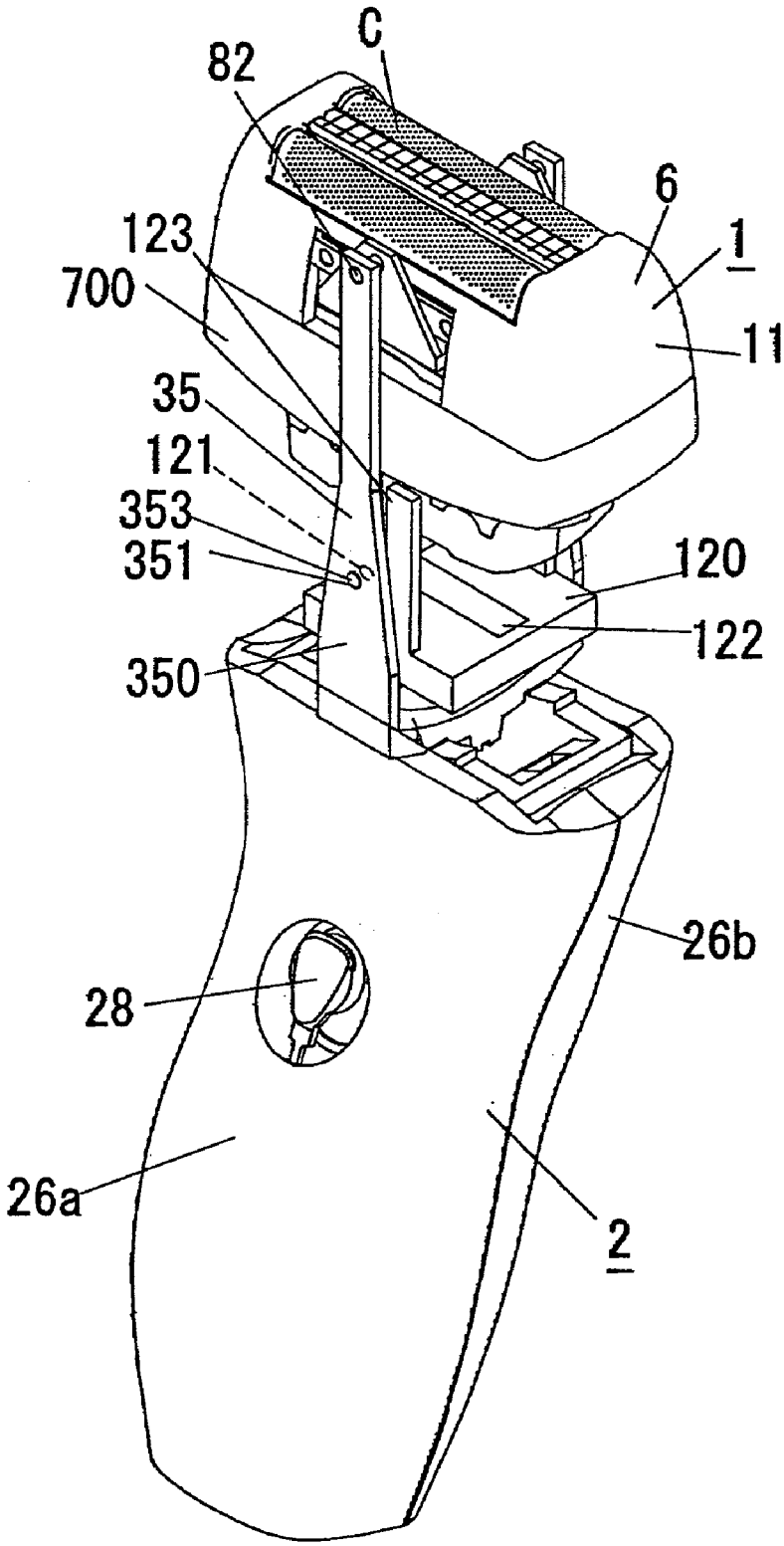
FIG. 20 is a perspective view showing an electric shaver in accordance with a sixth embodiment of the present invention.
Figure 21:
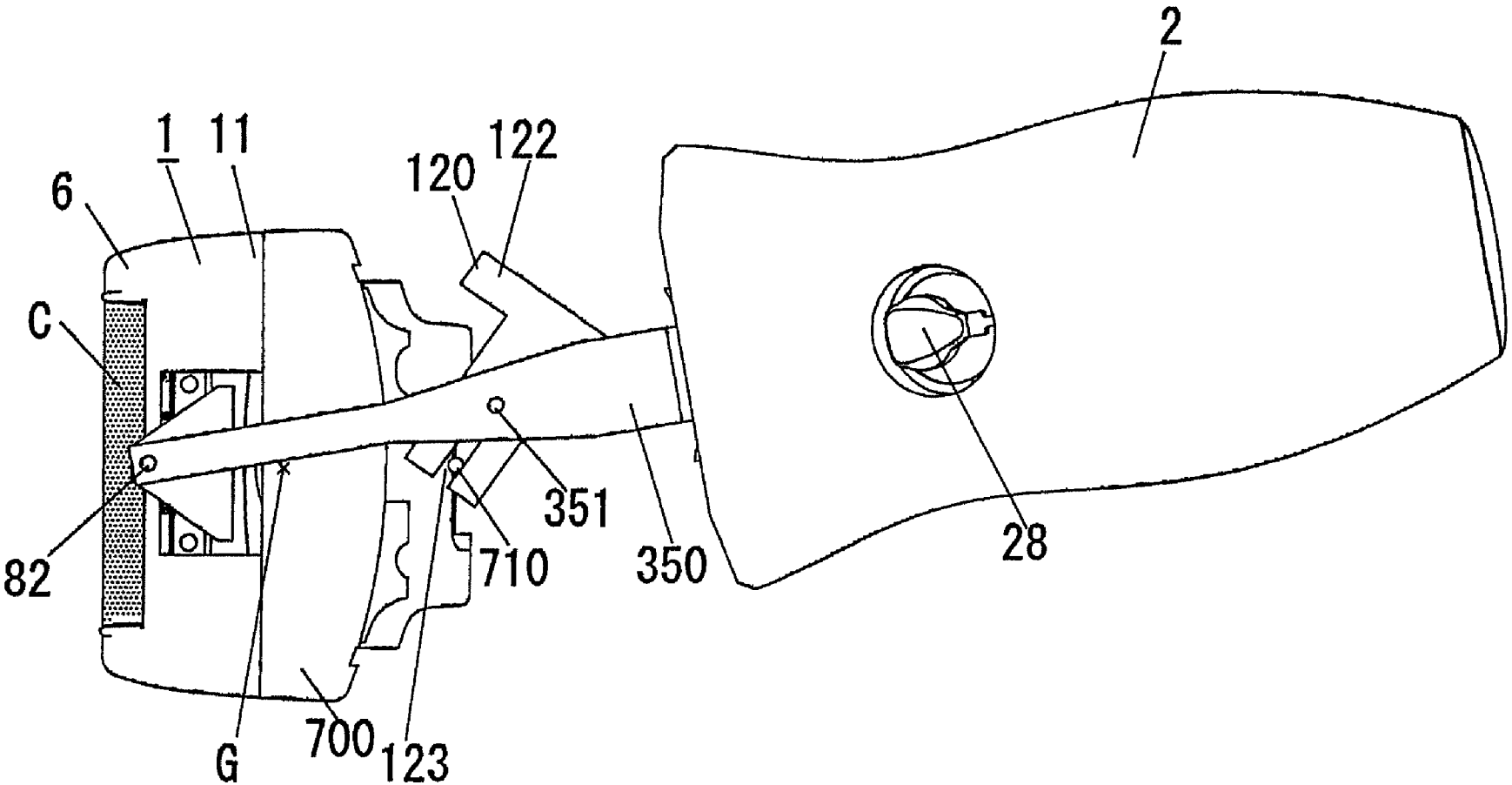
FIG. 21 is a side elevational view explaining an operation of the sixth embodiment.

Next, a description will be given of a sixth embodiment with reference to FIGS. 20 and 21. The present embodiment is basically the same as the first embodiment, however, the shaving head 1 is structured such as to be rotatable right and left with respect to the main body grip 2 in the sixth embodiment while the shaving head 1 is structured such as to be rotatable back and forth in the first embodiment. In other words, the shaving head 1 is structured such as to be rotatable in the right and left direction with respect to the main body grip 2 by the rotating shafts 82 at back and forth two positions.

A weight applying member 120 is arranged in the lower side of the shaving head 1, and is attached to an inner side between uprising pieces 35 in both sides of a U-shaped head support table 350. A hole 351 is provided in each of the uprising pieces 35 in both sides of the head support table 350, a boss rib 710 is provided in a head case 700 of the shaving head 1 so as to be positioned in a lower portion of the shaving head 1, the weight applying member 120 is arranged in such a manner that a dead weight 122 is below the hole 351, and a shaft 353 is inserted to the shaft hole 351 of the uprising piece 35 and a shaft hole 121 (a broken line) of the weight applying member 120 so as to be installed in such a manner that the weight applying member 120 is rotatable around the shaft 353. A long groove 123 is provided in an opposite end portion to the weight 122 of the weight applying member 120, and the weight applying member 120 and the shaving head 1 are coupled by slidably engaging the long groove 123 with the boss rib 710.

Since the shaving head 1 is structured such as to be rotatable in the right and left direction with respect to the main body grip 2, the shaving head 1 is not affected by its own weight on the basis of the weight applying member 120 serving as the weight applying means in accordance with the present invention even if the rotational direction is different from that of the embodiment mentioned above, it is possible to maintain the balance at the angle of every tilt of the shaving head 1, and the shaving head 1 can be smoothly rotated without being affected by the empty weight with respect to the main body grip 2 at every grip angle. Accordingly, it is possible to make the blade portion of the shaving head 1 smoothly follow to the skin, it is possible to shave short and it is possible to reduce the unshaved portion.

Seventh Embodiment

Figure 22:
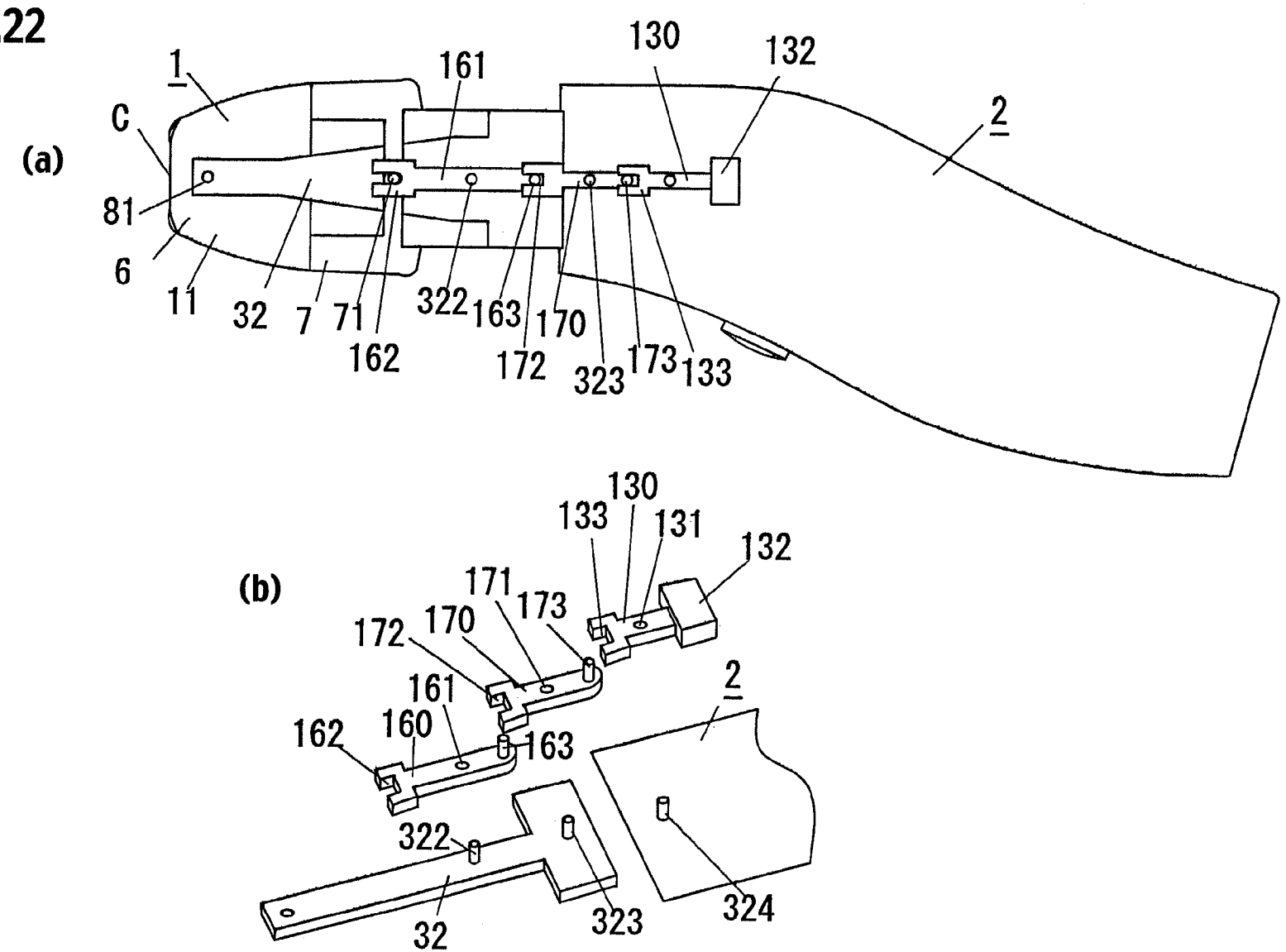

Next, a description will be given of a seventh embodiment with reference to FIG. 22. The present embodiment is basically the same as the embodiment mentioned above, however, is structured such as to transmit by a link at a time of arranging a dead weight 132 of a weight applying member 130 in the main body grip portion 2. A rotating shaft 322 is provided in the uprising piece 32, a hole 161 of a first link 160 is rotatably fitted to the rotating shaft 322, a long groove 162 in one end of the first link 160 is slidably engaged with the boss rib 71, and a boss rib 163 is provided in the other end of the first rink 160. A rotating shaft 323 is provided in the uprising piece 32 or the main body grip 2, a hole 171 of a second link 170 is rotatably fitted to the rotating shaft 323, a long groove 172 in one end of the second link 170 is slidably engaged with the boss rib 163, and a boss rib 173 is provided in the other end of the second link 170. A boss 324 is provided in the main body grip 2, a hole 131 of the weight applying member 130 is rotatably fitted to the boss 324, a long groove 133 in one end of the weight applying member 130 is slidably engaged with the boss rib 173, and the dead weight 132 is provided in the other end of the weight applying member 13.

In this case, it is possible to connect the weight applying member 130 and the shaving head 1 via the first link 160 and the second link 170, the shaving head 1 is not affected by its own weight on the basis of the weight applying member 130, it is possible to maintain the balance at the angle of every tilt of the shaving head 1, and the shaving head 1 can be smoothly rotated without being affected by the empty weight with respect to the main body grip 2 at every grip angle. Further, it is possible to set the weight applying member 130 below the shaving head 1 by connecting via the first link 160 and the second link 170, it is possible to prevent the weight from being biased to the shaving head 1, it is possible to set the gravity point of the electric shaver close to the main body grip 2 side, it is possible to easily hold, it is easy to move, and an improved usability is obtained.

In this case, in the first to seventh embodiments mentioned above, the shape of the weight applying means, the material having the great specific gravity, the shaft supporting point of the rotation, the long groove for transmission (for example, the concavity and the convexity may be inverted in the structures of the boss rib and the long groove, and a long hole may be employed in place of the long groove) and the like in accordance with the present invention are not limited to the embodiments mentioned above, but various structures can be employed, and it is possible to freely set the mounting position or the like. Further, the weight of the dead weight of the weight applying means in accordance with the present invention is not set to the weight balancing with the shaving head 1, but may be, for example, set to be smaller than the balance weight. In the case that the weight of the dead weight is set small as mentioned above, it is possible to achieve a downsizing of the electric shaver, and it is possible to be less affected by its own weight of the shaving head 1.

Further, in the embodiments mentioned above, the description is given of the hair removing device having the weight applying means in accordance with the present invention on the basis of the electric shaver, however, the hair removing device is not limited to the electric shaver, but can be applied, for example, to a depilating apparatus, a hair dressing device such as a hair clipper cutting the hair, a trimmer apparatus cutting a downy hair on the face and the like. In other words, it is possible to apply to the hair removing apparatus structured such that the body hair treatment head A is rotated with respect to the main body grip 2, and the body hair treatment head A can be smoothly rotated without being affected by its own weight by applying the weight applying means to the apparatuses. Accordingly, it is possible to make the blade portion of the body hair treatment head A smoothly follow to the skin, and the same effects can be obtained.

Eighth Embodiment

Figure 23:
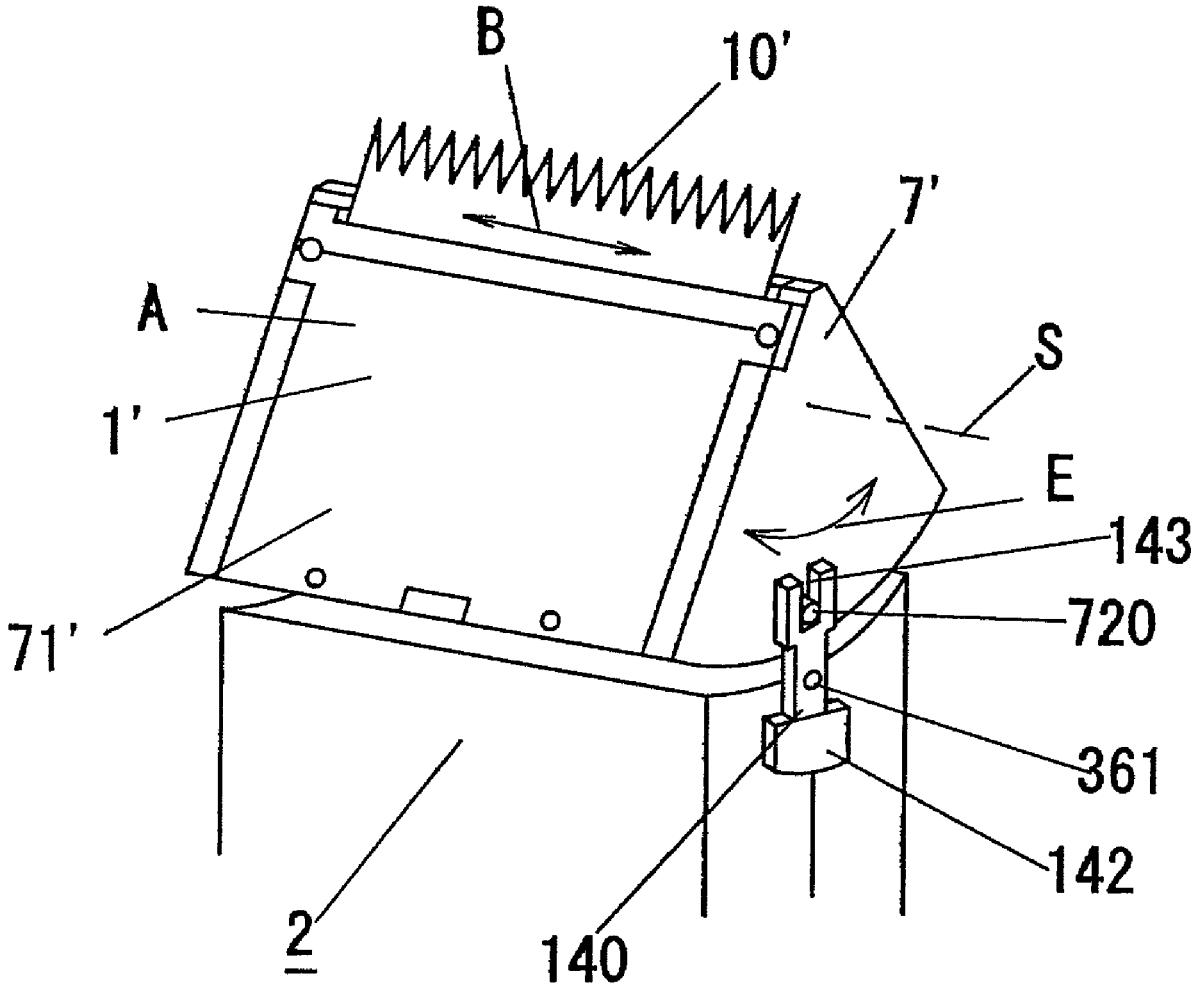
FIG. 23 is a perspective view showing a hair clipper in accordance with an eighth embodiment of the present invention.
Figure 24:
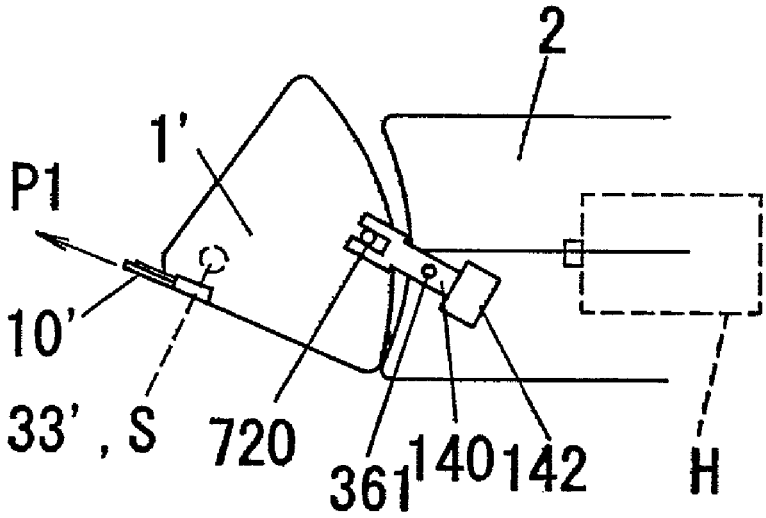
FIGS. 24A and 24B are side elevational views explaining an operation of the eighth embodiment.
Figure 24:
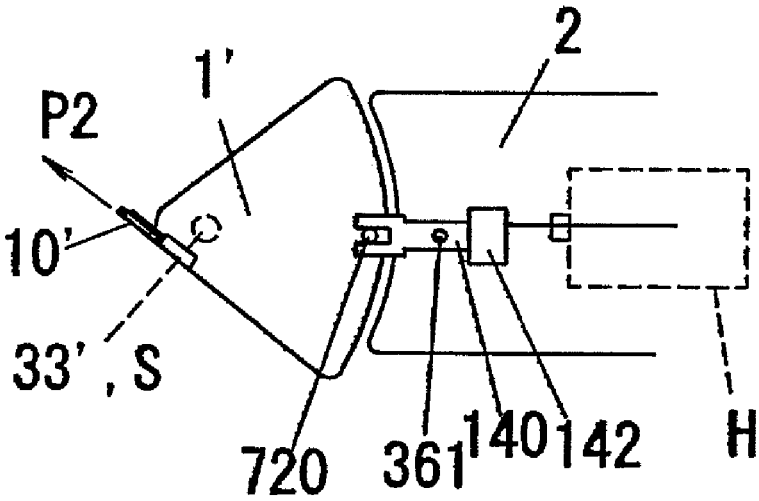

Next, a description will be given of a hair dressing device corresponding to an eighth embodiment with reference to FIGS. 23 and 24. The present embodiment corresponds to a hair clipper serving as the hair dressing device cutting the hair, and is provided with the weight applying means in the same manner as the electric shaver mentioned in the embodiments mentioned above. In the case of the present embodiment, the body hair treatment head A rotatably provided in such a manner as to be oscillated with respect to the main body grip 2 is constituted by a hair clipper head 1', and is provided with a cutting blade 10' in which a saw-tooth movable blade is brought into slidable contact with a saw-tooth fixed blade (refer to Japanese Patent Application Laid-Open No. 2004-216067). A head support shaft 33' is provided in the hair clipper head 1', and is structured such as to swing around an axis S which is in parallel to a sliding direction B of the cutting blade 10' of the hair clipper head 1'. In this case, the head support shaft 33' is provided in a protruding manner in both inner walls of the head shell 7' of the hair clipper head 1', and the hair clipper head 1' is rotated around the axis S which is approximately in parallel to a sliding direction of the cutting blade 10' of the hair clipper head 1' with respect to the main body grip 2 in such a manner that a skin contact surface 71' of the head shell 7' of the hair clipper head 1' is always in contact with the skin. In other words, the structure is made such that the hair clipper head 1' swings in a back and forth direction shown by an arrow E in FIG. 23.

A weight applying member 140 in accordance with the present invention is installed rotatably around a shaft 361 provided in the main body grip 2 below the hair clipper head 1', and has a dead weight 142 in one side of the weight applying member 140, and a long groove 143 provided in the other side is engaged slidably with a boss shaft 720 provided in the hair clipper head 1'.

The structure is made such that the hair clipper head 1' is made rotatable around the axis S which is approximately in parallel to the sliding direction B of the cutting blade 10' with respect to the main body grip 2. The hair clipper head 1' is not affected by its own weight by setting the weight applying member 140 in accordance with the present invention, it is possible to maintain the balance at the angle of every tile of the hair clipper head 1', the hair clipper head 1' can be smoothly rotated at every grip angle with respect to the main body grip 2 without being affected by its own weight, it is possible to make the skin contact surface 71' and the cutting blade 10' smoothly follow to the skin, and it is possible execute a cutting operation smoothly.

In this case, FIG. 24A shows a downward maximum position P1 (a position at which the hair clipper head 1' is tilted downward to the maximum in a horizontal state of the main body grip 2), and FIG. 24B shows an intermediate position P2, respectively. As mentioned above, the weight applying means in accordance with the present invention can be applied to the hair clipper having one cutting blade 10' as mentioned above, and can be also applied to the depilating apparatus plucking out the hair, the hair dressing device cutting the hair, the trimmer cutting the downy hair on the face and the like, can be smoothly rotated without being affected by its own weight, in the structure in which the body hair treatment head A is rotated, it is possible to make the blade portion smoothly follow to the skin, and the same effects as mentioned above can be obtained.

Further, in the eighth embodiment, a motor H serving as a drive source is provided in the main body grip 2 side, however, even if the motor H serving as the drive source is not provided in the head side, the same effects as mentioned above can be obtained.

As mentioned above, the weight applying means in accordance with the present invention is not structured such that the spring is provided in such a manner as to return the body hair treatment head A rotating with respect to the main body grip 2 to the initial position as is different from Japanese Patent Application Laid-Open No. 6-335575, but can maintain the tilt of the body hair treatment head A at every angle of the body hair treatment head A without being affected by its own weight or with being less affected. Accordingly, in order to prevent the body hair treatment head A from being tilted with respect to the main body grip 2 by the friction such as the rotation or the like, the spring may be provided such as the structure in Japanese Patent Application Laid-Open No. 6-335575. At this time, since the spring does not necessarily support the body hair treatment head A, the spring can be provided in such a manner as to have a very small rigidity, it is possible to smoothly rotate the body hair treatment head A with respect to the main body grip 2, an improved usability is obtained, a plurality of blade portions are not detached from the skin, a uniform pressing is obtained in each of the blade portions, and it is possible to shave short.

INDUSTRIAL APPLICABILITY

Since the present invention is provided with the weight applying means as mentioned above, the body hair treatment head is not affected by its own weight or is less affected, and can maintain the balance at the angle of every tilt of the body hair treatment head, and the body hair treatment head is hard to be affected by its own weight and can be smoothly rotated. Accordingly, it is possible to make the blade portion of the body hair treatment head smoothly follow to the skin, and there can be obtained an effect that it is possible to smoothly and securely remove the hair.

The invention claimed is:

1. A hair removing apparatus comprising:

a body hair treatment head removing a body hair, the body hair treatment head including two opposing longitudinal sides, two opposing lateral sides, and a first engagement member;

a main body grip held by a hand;

the body hair treatment head being rotatably coupled to the main body grip in such a manner that the body hair treatment head is freely oscillated with respect to the main body, grip;

a support member provided in the main body grip;

a rotation support portion provided at the support member; and a weight system that applies a force opposing to an oscillating force by the weight of the body hair treatment head around a center of rotation of the body hair treatment head, the weight system comprising a weight member provided on at least one of the opposite lateral sides of the body hair treatment head, wherein the weight member includes a link portion rotatably supported portion, a weight provided at one end of the weight member, and a second engagement member provided at the other end of the weight member, the second engagement member engaging with the first engagement member of the body hair treatment head.

2. A hair removing apparatus as claimed in claim 1, wherein the weight system is installed to a longitudinal main body grip side.

3. A hair removing apparatus as claimed in claim 1, wherein the weight member is installed rotatably to a longitudinal main body grip side, the weight is provided in one side of the weight member with respect to a center of rotation of the weight member and the other side is coupled to the body hair treatment head.

4. A hair removing apparatus as claimed in claim 1, wherein the weight member is provided in a side portion of the body hair treatment head in a direction orthogonal to a direction in which the body hair treatment head is oscillated.

5. A hair removing apparatus as claimed in claim 1, wherein the body hair treatment head side is set to an upper side and the main body grip side is set to a lower side, and the weight member is provided in a lower side of the body hair treatment head.

6. A hair removing apparatus as claimed in claim 1, wherein a force of rotation moment applied so as to oppose to a moment of rotation of the body hair treatment head by the weight member is made equal to or smaller than a force of rotation moment generated by the body hair treatment head around a center of rotation of the body hair treatment head.

7. A hair removing apparatus as claimed in claim 1, wherein the weight member is provided in the main body grip side, and a force applied from the weight member is transmitted via a link.

8. A hair removing apparatus as claimed in claim 1, wherein the body hair treatment head is driven by a motor for removing hair.

9. A hair removing apparatus as claimed in claim 1, wherein the hair removing apparatus is constituted by an electric shaver, the body hair treatment head is constituted by a shaving head having a blade comprising an outer blade for cutting the hair and an inner blade brought into inside contact with the outer blade so as to reciprocate, the shaving head is provided with a rotating shaft support portion of the shaving head in an end portion in the reciprocating direction of the inner blade, and a rotating shaft support portion of the weight member is provided in a support table of the main body grip.

10. A hair removing apparatus as claimed in claim 1, wherein a portion coupling the weight member to the body hair treatment head is provided in an opposite side to a rotation support point of the body hair treatment head, with respect to a gravity point of the body hair treatment head.

11. A hair removing apparatus as claimed in claim 1, wherein the first engagement member is a projection and the second engagement member is a long groove.

12. A hair removing apparatus as claimed in claim 1, wherein the first engagement member is a long groove and the second engagement member is a projection.

13. A hair removing apparatus as claimed in claim 1, wherein the first engagement member is a projection and the second engagement member is a long hole.

14. A hair removing apparatus as claimed in claim 1, wherein the first engagement member is a long hole and the second engagement member is a projection.

* * * * *

UNITED STATES PATENT AND TRADEMARK OFFICE

CERTIFICATE OF CORRECTION

PATENT NO. : 7,832,104 B2
APPLICATION NO. : 11/577826
DATED : November 16, 2010
INVENTOR(S) : M. Yamasaki et al.

It is certified that error appears in the above-identified patent and that said Letters Patent is hereby corrected as shown below:

At column 16, line 46 (claim 1, line 22) of the printed patent, please insert -- by the rotation support -- after "supported".

Signed and Sealed this
Fourteenth Day of June, 2011

David J. Kappos

David J. Kappos
*Director of the United States Patent and Trademark Office*